US005890542A

United States Patent [19]

Ringgenberg

[11] Patent Number: 5,890,542

[45] Date of Patent: Apr. 6, 1999

[54] APPARATUS FOR EARLY EVALUATION FORMATION TESTING

[75] Inventor: Paul D. Ringgenberg, Carrollton, Tex.

[73] Assignee: Halliburton Energy Services, Inc., Dallas, Tex.

[21] Appl. No.: 829,923

[22] Filed: Apr. 1, 1997

[51] Int. Cl.[6] ..... E21B 34/00

[52] U.S. Cl. ..... 166/374; 166/321

[58] Field of Search ..... 166/373, 374, 166/317, 320, 321, 329, 331, 332.3, 240

[56] References Cited

U.S. PATENT DOCUMENTS

| | | | |
|---|---|---|---|
| 4,633,952 | 1/1987 | Ringgenberg | 166/321 |
| 4,667,743 | 5/1987 | Ringgenberg et al. | 166/321 |
| 4,817,723 | 4/1989 | Ringgenberg | 166/321 |
| 4,979,568 | 12/1990 | Spencer, III et al. | 166/321 |
| 5,482,119 | 1/1996 | Manke et al. | 166/321 |
| 5,518,073 | 5/1996 | Manke et al. | 166/321 |

*Primary Examiner*—William Neuder

*Attorney, Agent, or Firm*—Paul I. Herman; Lawrence R. Youst

[57] ABSTRACT

A downhole tool (34) comprising a housing (60), a mandrel (76) slidably disposed within the housing (60), the mandrel (76) having a fluid passageway (52) extending axially therethrough, a valve (50) disposed within the mandrel (76), the valve (50) having first and second positions to selectively permit and prevent fluid flow through the fluid passageway (52) of the mandrel (76) and first and second pistons (98, 104) slidably disposed between the housing (60) and the mandrel (76), the first and second pistons (98, 104) slidably displacable in opposite directions relative to the housing (60) in response to a differential fluid pressure, the first and second pistons (98, 104) selectively engagable with the mandrel (76) to respectively displace the mandrel (76) in first and second directions, thereby operating the valve (50) between said first and second positions.

39 Claims, 13 Drawing Sheets

APPARATUS FOR EARLY EVALUATION FORMATION TESTING

TECHNICAL FIELD OF THE INVENTION

This invention relates in general to testing and evaluation of subterranean formations and, in particular to, an apparatus for early evaluation formation testing of oil, gas or water formations intersected by a wellbore.

BACKGROUND OF THE INVENTION

Without limiting the scope of the present invention, its background is described with reference to testing hydrocarbon formations, as an example.

It is well known in the subterranean well drilling and completion art to perform tests on formations intersected by a wellbore. Such tests are typically performed in order to determine geological or other physical properties of the formation and fluids contained therein. For example, parameters such as permeability, porosity, fluid resistivity, temperature, pressure and bubble point may be determined. These and other characteristics of the formation and fluid contained therein may be determined by performing tests on the formation before the well is completed.

It is of considerable economic importance for tests such as these to be performed as soon as possible after the formation has been intersected by the wellbore. Early evaluation of the potential recovery from a formation is very desirable. For example, such early evaluation enables completion operations to be planned more efficiently.

Where the early evaluation is performed during drilling operations, the drilling operation may be performed more efficiently in that the results of the early evaluation may be used to adjust the drilling parameters. For example, formation testing equipment may be interconnected with a drill string so that, as the wellbore is being drilled, formations intersected by the wellbore may be periodically tested.

It has been found, however, that conventional formation testing equipment is not suitable for interconnection with a drill string during a drilling operation. For example, typical formation testing equipment requires absolute downhole fluid pressure for operation. Typically, it is necessary to provide precharged gas chambers or other pressure reference devices to reach the required fluid pressure to appropriately actuate the equipment. Additionally, such equipment usually requires that specific steps, such as opening and closing of valves and changes of configurations, happen upon attaining specific absolute fluid pressures. Accordingly, an operator at the surface must apply such absolute fluid pressures at the surface using pumps and simultaneously observe the fluid pressure in the wellbore and drill string to determine whether such absolute fluid pressure has been reached.

Therefore, a need has arisen for an early evaluation formation testing apparatus which is not cumbersome to operate or failure prone and does not rely upon absolute fluid pressure for actuation or changes in configuration. A need has also arisen for an early evaluation formation testing apparatus that provides for valve opening and closing as well as changes in configuration upon the release of pressure or upon reaching a desired differential pressure at the equipment.

SUMMARY OF THE INVENTION

The present invention disclosed herein comprises an apparatus for early evaluation formation testing of subterranean formations which is not cumbersome or failure prone and does not rely upon absolute fluid pressure for actuation or changes in configuration. The apparatus of the present invention allows for opening and closing of a valve and changes in configuration upon the release of pressure and upon reaching a desired differential pressure at the equipment.

The early evaluation formation testing tool of the present invention comprises a housing and a mandrel slidably disposed within the housing. The mandrel has a fluid passageway extending axially therethrough. The tool also comprises a valve disposed within the mandrel that is selectively positionable to permit and prevent fluid flow through the fluid passageway of the mandrel.

First and second pistons are slidably disposed between the housing and the mandrel and are slidably displacable in opposite directions relative to the housing in response to a differential fluid pressure. The first and second pistons are selectively engagable with the mandrel to respectively displace the mandrel in first and second directions to operate the valve.

The tool may also comprise a first ratchet mechanism that is rotatably disposed between the mandrel and the first piston and a second ratchet mechanism rotatably disposed between the mandrel and the second piston. First and second pins respectively extending radially inwardly from the first and second pistons to selectively engagable the first and second ratchet mechanisms such that the mandrel is selectively displaceable in the first direction when the first piston is displaced in the first direction and selectively displaceable in the second direction when the second piston is displaced in the second direction.

A limiter is slidably disposed between the mandrel and the housing to stall the displacement of the first piston in the first direction responsive to the differential fluid pressure. In one embodiment, the limiter may be a collet spring having a plurality of deformable segments. In another embodiment, the limiter may be a staging piston having a plurality of differential pressure areas such that the differential pressure required to displace the first piston changes depending upon the axial position of the staging piston relative to the housing.

The limiter stalls the displacement of the first piston when the differential fluid pressure is reduced from a first predetermined differential fluid pressure to a second predetermined differential fluid pressure. The first pin engages the first ratchet mechanism when the differential fluid pressure is increased from the second predetermined differential fluid pressure to a third predetermined differential fluid pressure and then reduced a fourth predetermined differential fluid pressure. The mandrel is displaced in the first direction when the differential fluid pressure is reduced below the fourth predetermined differential fluid pressure, thereby operating the valve from the first position to the second positions.

The second pin engages the second ratchet mechanism when the differential fluid pressure is increased to a fifth predetermined differential fluid pressure and reduced to a sixth predetermined differential fluid pressure. The mandrel is displaced in the second direction when the differential fluid pressure is reduced below the sixth predetermined differential fluid pressure, thereby operating the valve from the second position to the first positions.

The first predetermined differential fluid pressure may be more than about 160 psi. The second predetermined differential fluid pressure may be about 120 psi. The third predetermined differential fluid pressure may be more than about 160 psi. The fourth predetermined differential fluid pressure may be less than about 120 psi. The fifth predetermined differential fluid pressure may be more than about 160 psi. The sixth predetermined differential fluid pressure may be less than about 120 psi.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and do not delimit the scope of the invention.

Figure 1:
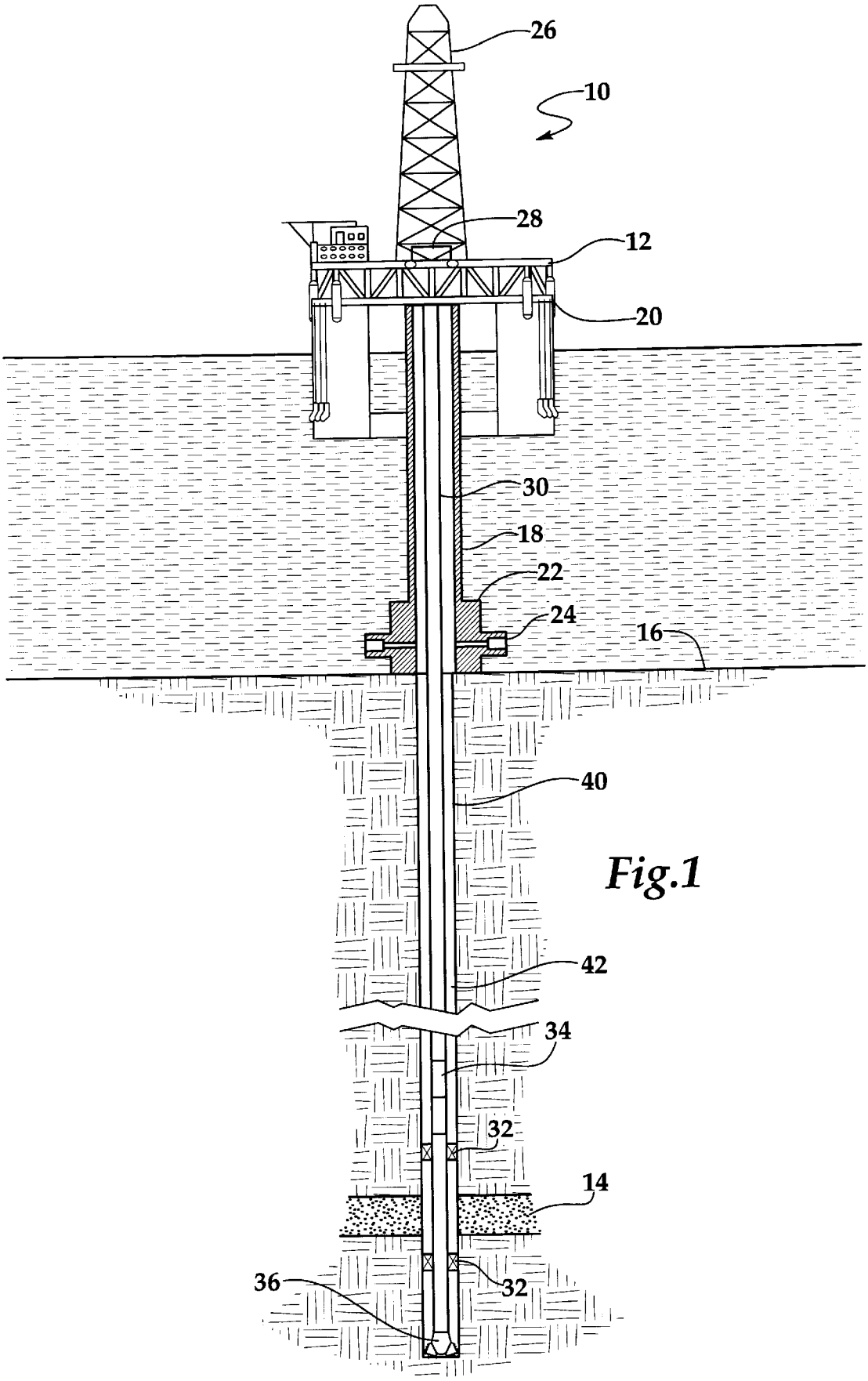
FIG. 1 is a schematic illustration of an offshore oil or gas drilling platform operating an early evaluation formation testing apparatus of the present invention.

Referring to FIG. 1, an early evaluation testing tool in use on an offshore oil or gas drilling platform is schematically illustrated and generally designated 10. A semisubmersible drilling platform 12 is centered over a submerged oil or gas formation 14 located below sea floor 16. A subsea conduit 18 extends from deck 20 of platform 12 to a wellhead installation 22 including blowout preventor 24. The platform 12 has a derrick 26 and a hoisting apparatus 28 for raising and lowering drill string 30. Drill string 30 may include seal assemblies 32 and early evaluation formation testing tool 34.

During a drilling operation, drill bit 36 is rotated on drill string 30 to intersect formation 14 with wellbore 40. Shortly after formation 14 has been intersected by wellbore 40, the characteristics of formation 14 and the fluid contained therein may be tested using early evaluation formation testing tool 34. Seal assemblies 32 are set to isolate formation 14. The circulation rate of fluid inside drill string 30 is then adjusted to control the differential pressure between the interior of drill string 30 and annulus 42 at tool 34 to manipulate the internal mechanisms of tool 34 and perform an early evaluation of formation 14.

It should be understood by one skilled in the art that early evaluation testing formation tool 34 of the present invention is not limited to use on drill string 30 as shown in FIG. 1. For example, early evaluation testing tool may be used on a subsequent trip after a drilling operation. It should also be understood by one skilled in the art that tool 34 of the present invention is not limited to use with semisubmersible drilling platform 12 as shown in FIG. 1. Early evaluation formation testing tool 34 is equally well-suited for conventional offshore platforms or onshore operations. Additionally, it should be noted by one skilled in the art that tool 34 of the present invention is not limited to use with vertical wells as shown in FIG. 1. Early evaluation formation testing tool 34 is equally well-suited for deviated wells or horizontal wells.

In the following figures of early evaluation formation testing tool 34 of the present invention, directional terms such as upper, lower, upward, downward, etc. are used in relation to the illustrative embodiments as they are depicted in the figures, the upward direction being towards the top of the corresponding figure and the downward direction being toward the bottom of the corresponding figure. It is to be understood that tool 34 may be operated in vertical, horizontal, inverted or inclined orientations without deviating from the principles of the present invention. It is also understood that the embodiments are schematically represented in the accompanying figures.

Representatively illustrated in FIGS. 2A–2E and Figures 3A–3E is one embodiment of early evaluation formation testing tool 34 of the present invention. Tool 34 as it is represented in FIGS. 3A–3E is configured in the position which it would normally be running into wellbore 40 such that fluids may flow axially through open valve 50 (see FIG. 3D). Early evaluation testing tool 34 as represented in FIG. 2A–2E is configured such that valve 50 is in the closed position (see FIG. 2D), thereby preventing circulation of fluids through main axially flow passage 52 which extends from upper internal threaded end 54 to lower external threaded end 56 of tool 34. During a drilling operation, fluid, such as drilling mud, is circulated through drill string 30 to ports formed through drill bit 36 and up wellbore 40 by way of annulus 42. It is understood that tool 34 may be interconnected with such drill string 30 at its upper end 54 and lower end 56 without impeding such circulating flow of fluids therethrough during drilling operations.

Tool 34 in its open configuration as shown in FIGS. 3A–3E, may have fluid circulated downward through drill string 30, through flow passage 52 and through the ports in drill bit 36. From drill bit 36, such fluids are typically flowed back to the surface through annulus 42 formed radially between drill string 30 and wellbore 40.

Tool 34 is uniquely capable of performing a variety of functions in response to various differences in fluid pressure between flow passageway 52 and annulus 42. The absolute fluid pressure at any point in wellbore 40 is not determinative of the configuration of tool 34. It is the differential fluid pressure from the flow passage 52 to the annulus 42 that determines, among other things, whether valve 50 is open or closed. The differential pressure between flow passage 52 and annulus 42 is controllable by the operator and is generally proportional to the circulation rate of drilling mud.

Tool 34 includes an axially extending and generally tubular upper connector 58 which has upper end 54 formed thereon. Upper connector 58 may be threadably and sealably connected to a portion of drill string 30 for conveyance into wellbore 40. When so connected, flow passageway 52 is in fluid communication with the interior of drill string 30.

An axially extending generally tubular upper housing 60 is threadably and sealably connected to upper connector 58. Upper housing 60 is threadably connected to axially extending generally tubular intermediate housing 62, which is threadably connected to an axially extending generally tubular lower housing 64. Lower housing 64 is threadably and sealably connected to axially extending generally tubular valve housing 66 which is threadably and sealably connected to axially extending generally tubular operator housing 68 which is, in turn, threadably and sealably connected to axially extending generally tubular connector housing 70. Connector housing 70 is threadably and sealably connected to axially extending generally tubular lower connector housing 71 which is threadably and sealably connected to axially extending generally tubular lower adapter 72. Each of the above-described sealing connections are sealed by resilient o-ring seals 74.

Disposed within upper connector 58 is axially extending generally tubular inner mandrel assembly 76 which is slidably received within internal bore 78. Inner mandrel assembly 76 includes upper end portion 80, upper sleeve 82, intermediate sleeve 84, lower sleeve 86 and upper ball retainer 90. Upper end portion 80, upper sleeve 82, intermediate sleeve 84, lower sleeve 86 and upper ball retainer 90 are threadably interconnected. A generally tubular screen 92 for filtering debris from fluid passing therethrough is retained between internal shoulders formed on upper end portion 80 and upper sleeve 82 as well as lower sleeve 86 and upper ball retainer 90. Upper sleeve 82 and lower sleeve 86 include ports 94 formed therethrough radially opposite screens 92. Thus, fluid in flow passage 52 may flow radially through inner mandrel assembly 76 via ports 94.

Upper housing 60 and lower housing 64 include ports 96 formed radially therethrough. Ports 96 permit fluid in annulus 42 to enter tool 34. Together, ports 94 and 96 permit differential pressure between the fluid in flow passage 52 and the fluid in annulus 42 to act upon tool 34 in a manner which causes valve 50 to open or close as desired, among other operations.

Generally tubular upper piston 98 is slidably and sealably received radially between upper housing 60 and intermediate sleeve 84. External circumferential seal 100 carried on upper piston 98 internally engages upper housing 60 and internal circumferential seal 102 carried on intermediate housing 62 engages upper piston 98. Generally tubular lower piston 104 is slidably and sealably received radially between lower housing 64 and intermediate sleeve 84. External circumferential seal 106 carried on lower piston 104 engages lower housing 64 and internal seal 108 carried on intermediate housing 62 engages lower piston 104. Thus, a differential pressure area is formed between seal 100 and seal 102 as well as between seal 106 and seal 108.

It should be readily appreciated that when fluid pressure in flow passageway 52, acting on the differential pressure areas of upper piston 98 and lower piston 104 via ports 94, exceeds fluid pressure in annulus 42, acting on the differential pressure areas of upper piston 98 and lower piston 104 via ports 96, upper piston 68 will be biased in an axially downward direction and lower piston 104 will be biased in an axially upward direction. When fluid pressure in flow passageway 52 exceeds that of annulus 42, upper piston 96 and lower piston 104 are axially biased toward one another and, conversely, when fluid pressure in annulus 42 exceeds that in flow passage 52, upper piston 98 and lower piston 104 are axially biased away from one another. Internal opposing shoulders 110 formed on intermediate housing 62 limit the extent to which pistons 98, 104 may travel axially toward one another, and internal shoulders 112 formed on upper housing 30 and lower housing 34 limit the extent to which pistons 98, 104 may travel axially away from one another.

Spirally wound compression spring 114 is installed axially between external shoulder 116 formed on upper piston 98 and intermediate housing 62. Spirally wound compression spring 118 is installed axially between external shoulder 120 formed on lower piston 104 and intermediate housing 62. Springs 114, 118 are utilized to bias upper piston 98 and lower piston 104 axially away from one another. Thus, with no difference in fluid pressure between flow passage 52 and annulus 42, springs 114, 118 will act to maintain upper piston 98 and lower piston 104 in their greatest axially spaced apart configuration.

It is understood that other biasing devices and mechanisms may be substituted for springs 114, 118 without departing from the principles of the present invention. For example, gas springs or stacked Bellville washers may be utilized to bias upper piston 98 and lower piston 104 away from one another.

A generally tubular upper pin retainer 122 is threadably secured to upper end 124 of upper piston 98. A generally tubular lower pin retainer 126 is threadably secured to lower end 128 of lower piston 104. A series of five radially inwardly extending and circumferentially spaced apart pins 130 are installed through upper pin retainer 122, such that each of the pins 130 engage one of five corresponding J-slots or ratchet paths 132 externally formed on a generally tubular axially extending upper ratchet 134. A series of four radially inwardly extending and circumferentially spaced apart pins 136 are installed through lower pin retainer 126 such that each of the pins 136 engage one of four corresponding J-slots or ratchet paths 138 externally on a generally tubular axially extending lower ratchet 140.

Upper ratchet 134 and lower ratchet 140 are externally rotatably disposed on intermediate sleeve 84. Upper ratchet 134 and lower ratchet 140 are axially secured on intermediate sleeve 84 between external shoulders 142 formed on intermediate sleeve 84 and upper sleeve 82 and lower sleeve 86, respectively. Thus, when upper piston 98 and lower piston 104 are axially displaced relative to intermediate sleeve 84, the engagement of pins 130, 136 in the corresponding ratchet paths 132, 138, in some instances, cause ratchets 134, 140 to rotate about intermediate sleeve 84.

It should be noted by one skilled in the art that the number of pins 130, 136 and corresponding ratchet paths 132, 138 within ratchets 134, 140 may vary. The specific operation of pins 130, 136 in the corresponding ratchet paths 132, 138 as well as the rotation of ratchets 134, 140 about intermediate sleeve 84 will be specifically discussed with reference to FIGS. 6 and 7 below.

In operation, as the differential pressure between flow passage 52 and annulus 42 is increased by increasing the rate of circulation of fluids therethrough, upper piston 98 is biased axially downward from a resting position. Preferably, spring 114 has a preload force caused by compressing spring 114 when it is installed within tool 34. Thus, a minimum differential fluid pressure is required to begin axially displacing upper piston 98 downward. Preferably, the minimum differential fluid pressure is approximately 120 psi.

When the minimum differential fluid pressure is exceeded, upper piston 98 will be displaced axially downward relative to upper housing 60 and intermediate sleeve 84. As upper piston 98 is downwardly displaced, axially extending and generally tubular collet spring 146 which extends upwardly from upper pin retainer 122 is also downwardly displaced. Collet spring 146 has a radially outwardly extending enlarged portion 148 formed thereon which is received within a correspondingly radially enlarged interior portion 150 of upper housing 60 wherein collet spring 146 may move freely in response to changes in differential pressure. Piston 98 reaches a first position when, preferably, the differential fluid pressure is more than approximately 160 psi.

It should be readily apparent to one skilled in the art that a differential fluid pressure of approximately 500–1,000 psi is typically reached during drilling operations wherein fluid, such as drilling mud, is circulated through drill string 30. Therefore, during normal drilling operations, the differential fluid pressure is sufficient to cause piston 98 and collet spring 146 to displace relative to upper housing 60 from the resting position to the first position and from the first position to a position downwardly beyond the first position.

Figure 2A:
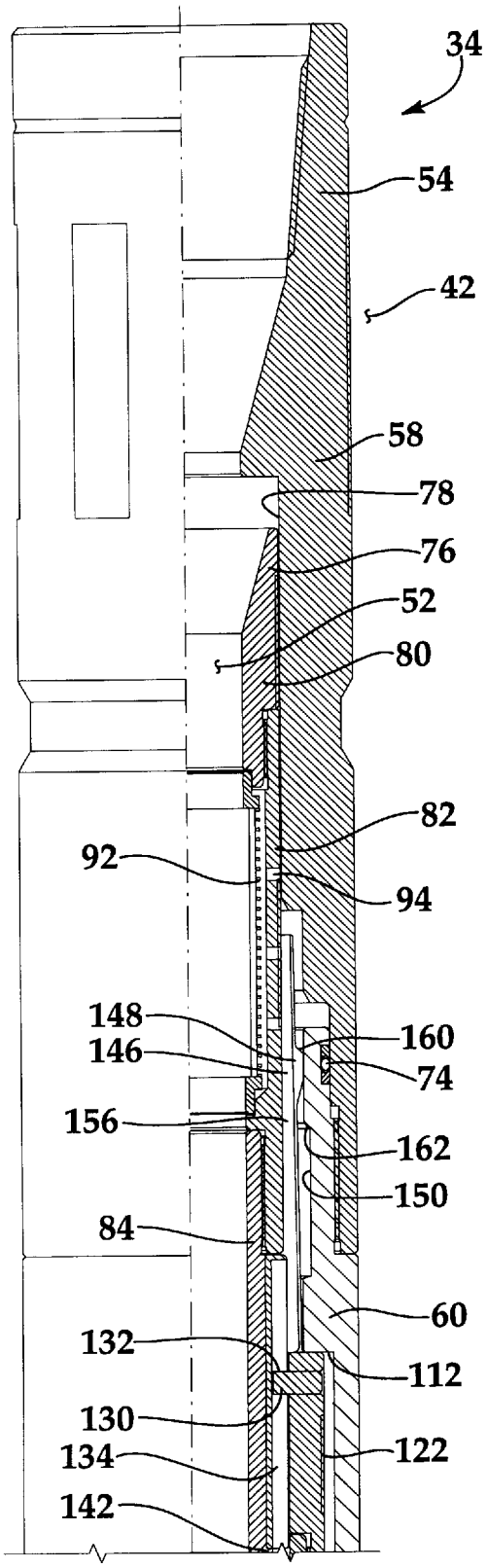
FIGS. 2A–2E are half sectional views partially cut away of successive axial portions of an early evaluation formation testing apparatus of the present invention in a closed position.
Figure 3A:
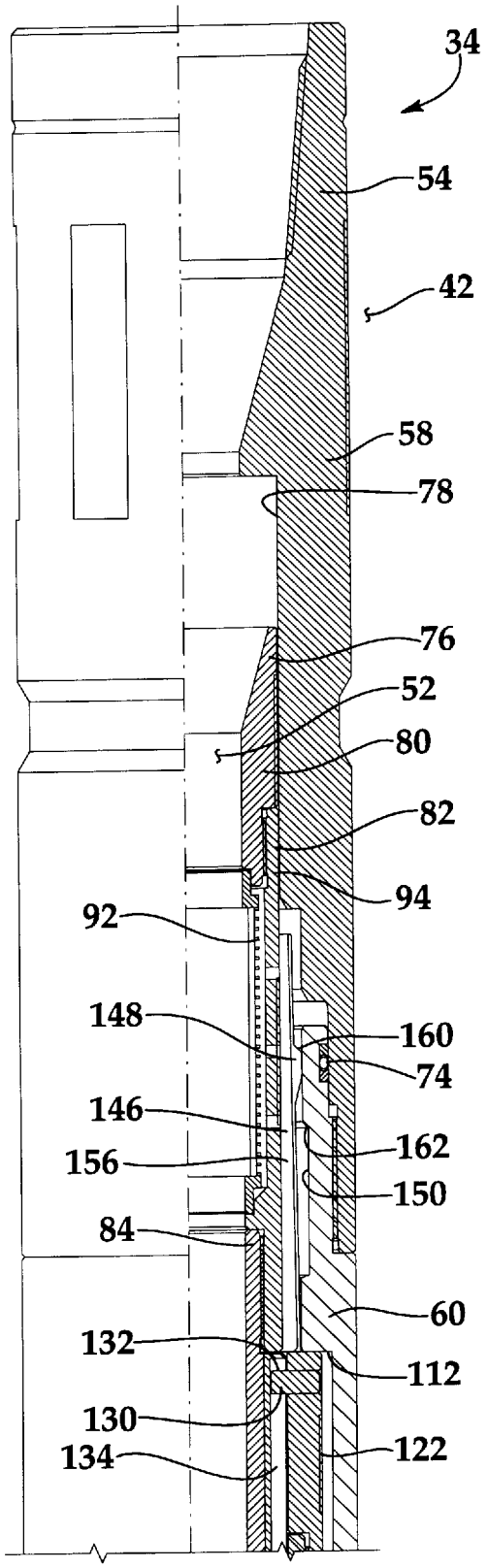
FIGS. 3A–3E are half sectional views partially cut away of successive axial portions of an early evaluation formation testing apparatus of the present invention in an open position.
Figure 3B:
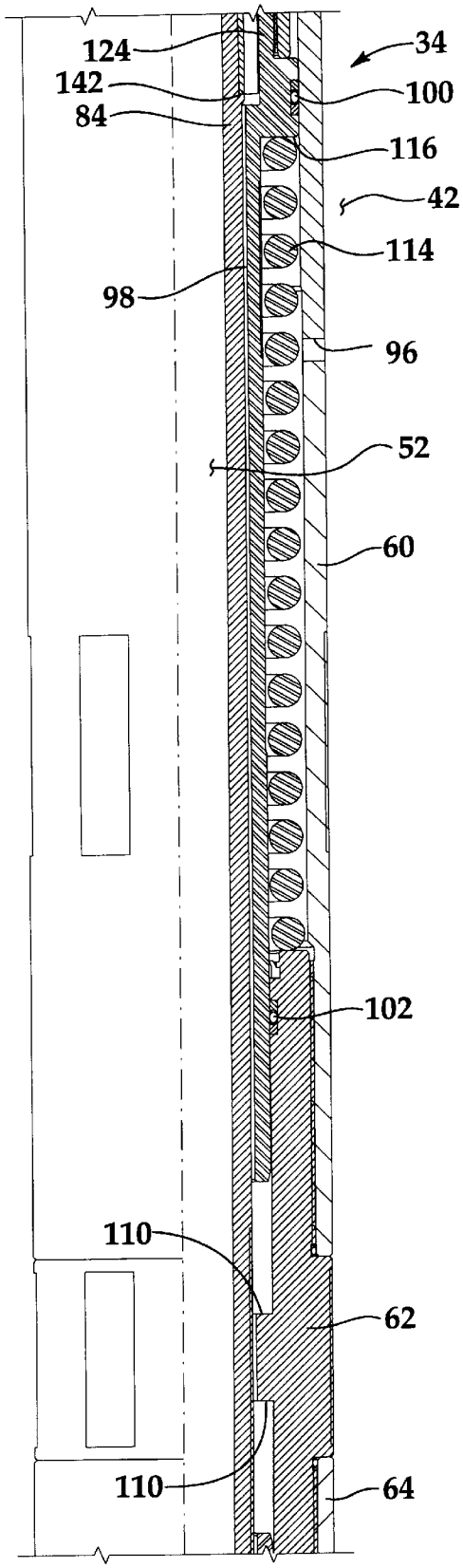

Collet spring 146 is circumferentially divided into a plurality of axially extending segments 156, only one of which is visible in FIGS. 2A and 3A. This circumferential division enables each of the segments 156 to be deflected radially inward. When the differential pressure is reduced, such as frequently occurs when drilling operations are temporarily suspended to add additional drill pipe to drill string 30, piston 98 and collet spring 146 axially displace upward relative to upper housing 60. As the differential fluid pressure is decreased, radially inclined upwardly facing surface 160 of radially enlarged portion 148 contacts radially inclined interior surface 162 of upper housing 60 and stalls the upward displacement of piston 98 and collet spring 146 placing upper piston 98 in a second position. Preferably, this contact occurs at a differential fluid pressure of approximately 120 psi. If further reduction in the differential fluid pressure occurs, segments 156 will be radially inwardly compressed enabling piston 98 and collet spring 146 to upwardly displace until upper pin retainer 122 contacts shoulder 112 returning upper piston 98 to the resting position. Preferably, segments 126 will be radially inwardly compressed at a differential fluid pressure of approximately 80 psi.

Thus, it should be clear that upper piston 98 is able to axially reciprocate within upper housing 60 during normal drilling operations where the differential fluid pressure is typically increased to approximately 500–1,000 psi and then decreased to approximately 0 psi when drill pipe is added to drill string 30.

If the differential fluid pressure is not decreased beyond the point at which the upward displacement of piston 98 is stalled by collet spring 146 but is instead increased, upper piston 98 will axially displace downward relative to upper housing 60 until downwardly facing radially inclined surface 152 engages upwardly facing radially inclined interior surface 154. A differential fluid pressure exceeding approximately 160 psi radially inwardly deflects radially enlarged portion 148 of collet spring 146 to further displace piston 98 downward relative to housing 60 placing upper piston in a third position.

A subsequent reduction in the differential pressure allows pins 130 to engage ratchet paths 132 placing upper piston 98 in a fourth position. Additional reduction in the differential fluid pressure will allow piston 98 to return to its resting position, thereby axially displacing inner mandrel assembly 76 in an upward direction.

Once inner mandrel assembly 76 has been displaced in the upward direction, an increase in the differential fluid pressure will axially displace lower piston 104 upward relative to lower housing 64 shifting lower piston 104 from a resting position to a first position. A subsequent reduction in the differential pressure will allow pin 136 to engage ratchet path 138 of ratchet 140, placing lower piston 104 in a second position. Addition reduction in the differential fluid pressure returns lower piston 104 to the resting position thereby shifting inner mandrel assembly 76 axially downward relative to lower housing 64.

Figure 2B:
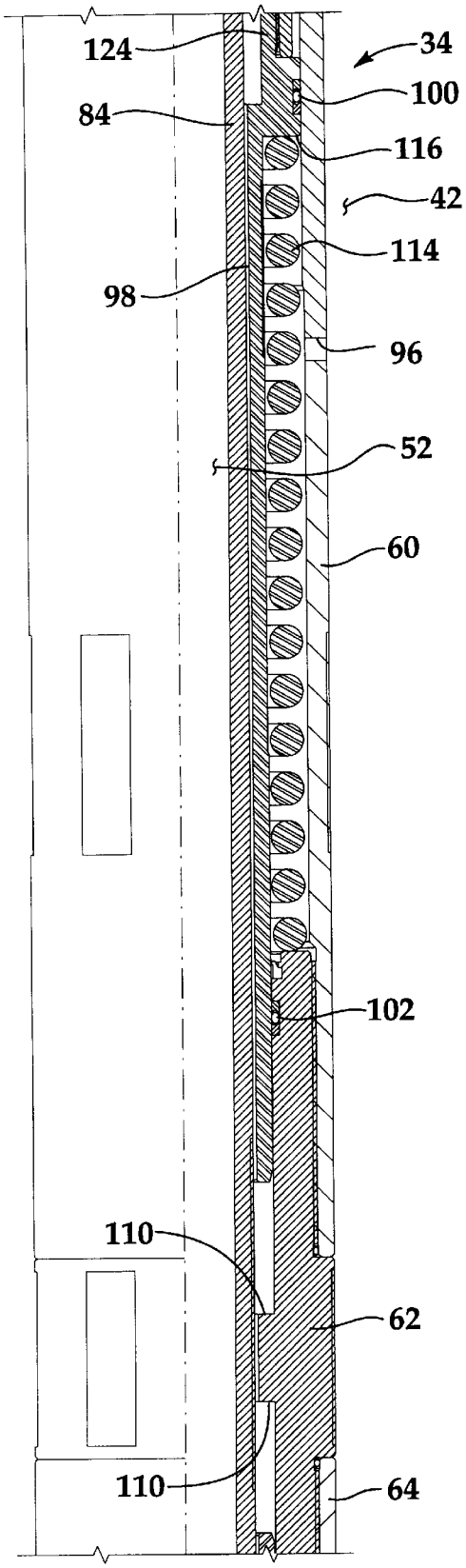
Figure 2C:
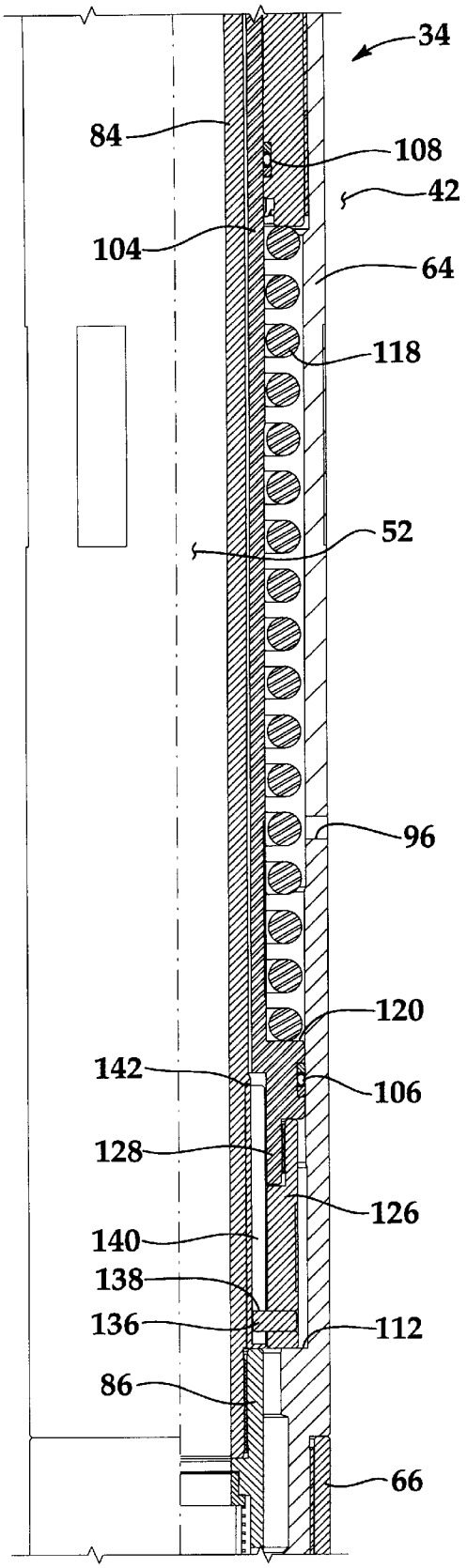
Figure 3C:
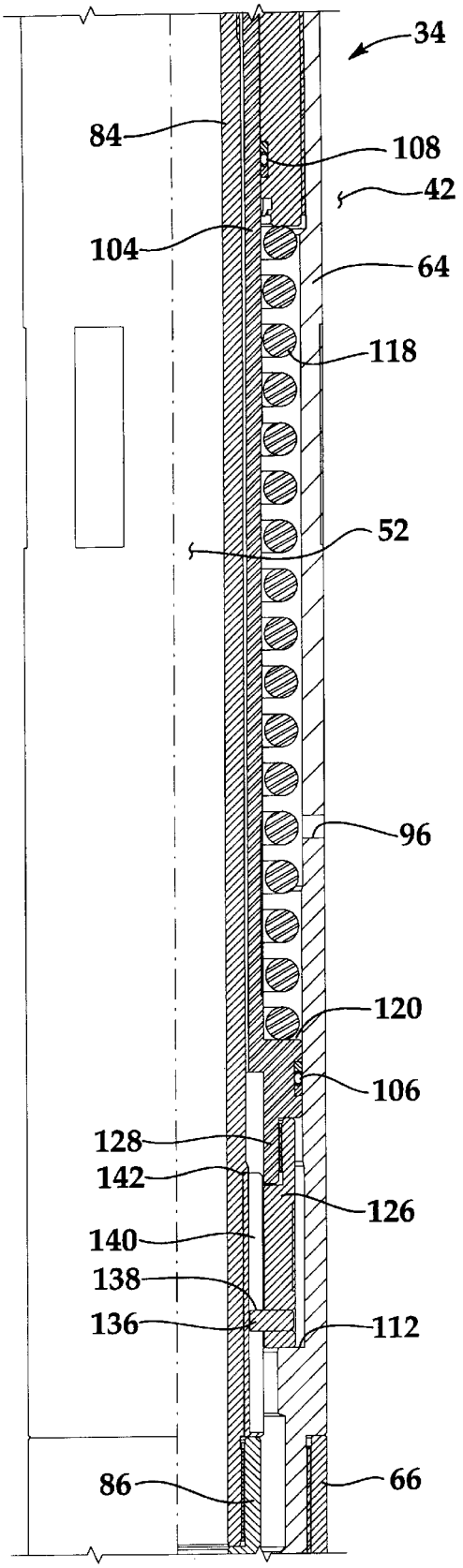
Figure 2D:
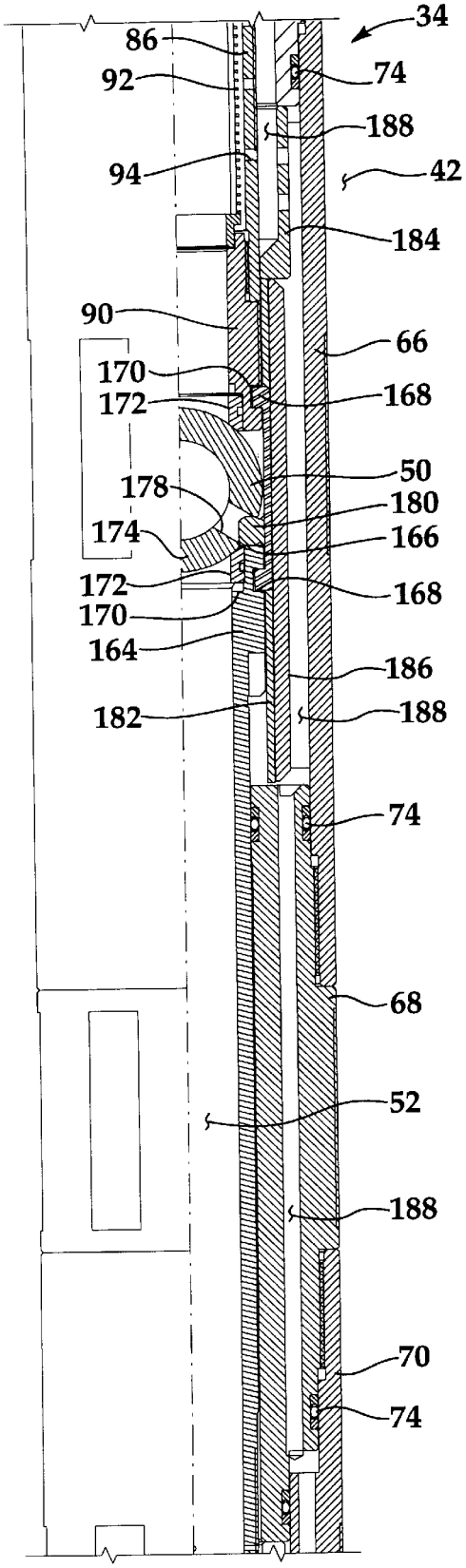
Figure 3D:
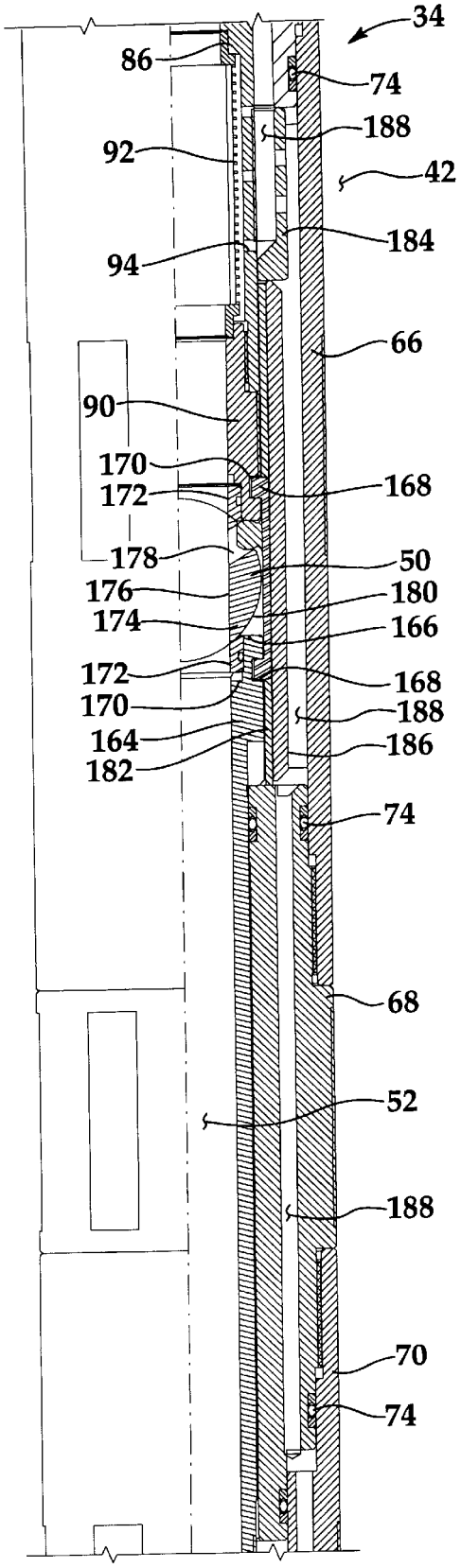

Referring specifically to FIGS. 2D and 3D, upper ball retainer 90 is axially secured to axially extending generally tubular lower ball retainer 164 by means of a circumferentially spaced apart series of generally C-shaped links 166. Radially inwardly projecting end portions 168 formed on each of the links 166 are received in complimentary shaped grooves 170 formed on each of the upper and lower ball retainers 90, 164. A ball seat 172 of conventional design axially slidingly and sealingly received in each of the upper and lower ball retainers 90, 164. Ball seats 172 also sealingly engage ball 174, which has an opening 176 formed axially therethrough. With valve 50 in its open configuration, the flow passage 52 extends axially through opening 176.

Two eccentrically extending openings 178 are formed through ball 174. Openings 178 are utilized to rotate ball 174 about an axis perpendicular to opening 176, in order to isolate opening 176 from flow passage 52 and thereby, close valve 50. As seen in FIG. 2D, ball 174 is rotated about is axis such that opening 176 is in fluid isolation from flow passage 52 by sealing engagement of ball seats 172 with ball 174.

A lug 180 is received in each of the openings 178. Each of the lugs 180 projects inwardly from an axially extending lug member 182. Links 166 and lug members 182 are disposed circumferentially about ball 174 and ball retainers 90, 164. Due to the eccentric placement of openings 178, lug members 182 displace somewhat circumferentially when ball 174 is rotated, lugs 180 being retained in openings 178 as ball 174 rotates.

Figure 6:
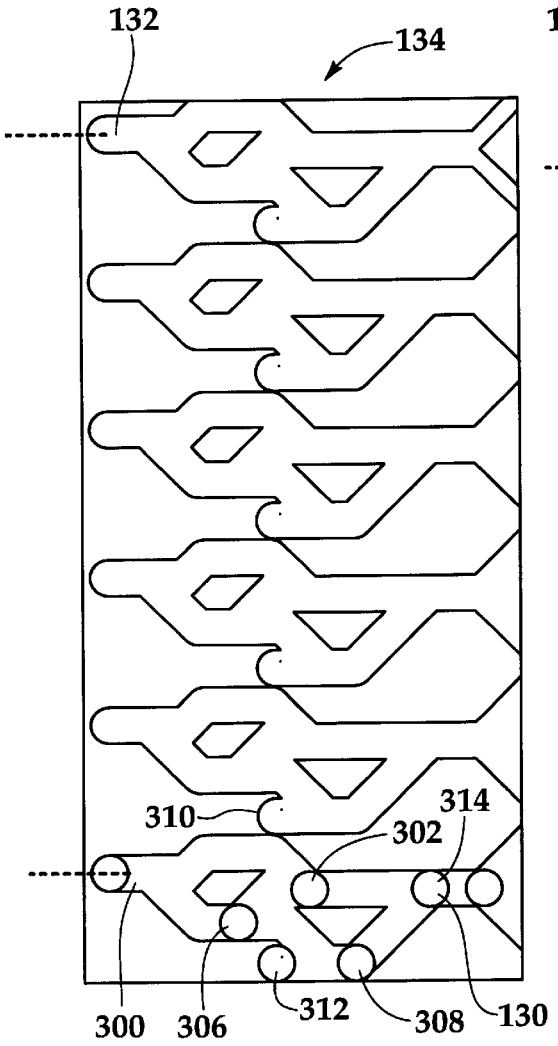
FIG. 6 is a circumferential view of a ratchet sleeve showing various positions of the ratchet sleeve with respect to pins received in a ratchet patch.
Figure 7:
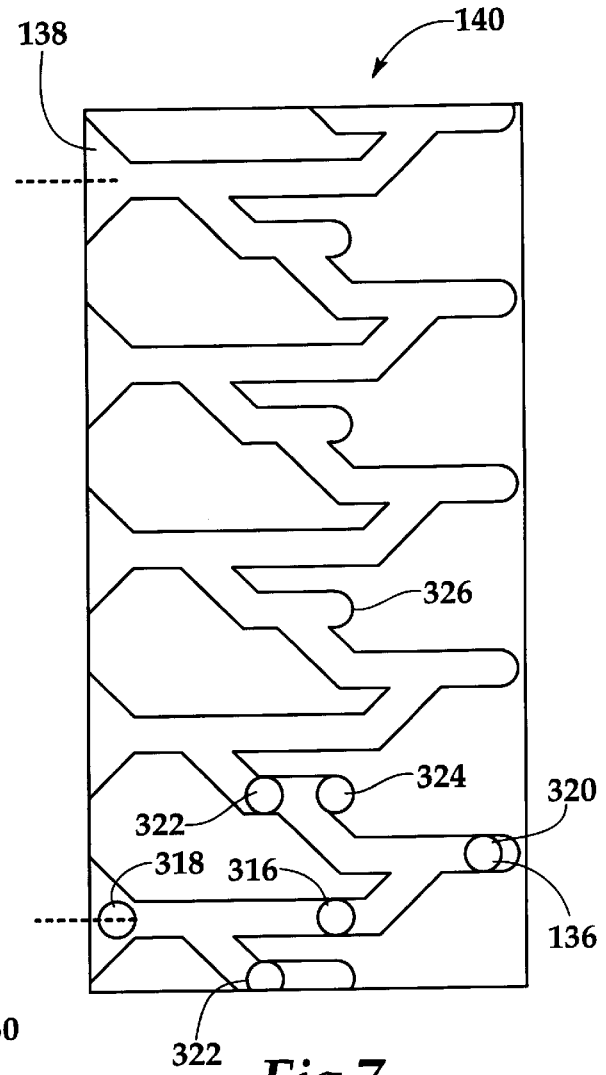
FIG. 7 is a circumferential view of a ratchet sleeve showing various positions of the ratchet sleeve with respect to pins received in ratchet paths.

When internal mandrel assembly 76 is displaced axially upward as will be more fully described in conjunction with FIGS. 6 and 7, upper ball retainer 90, links 166, lower ball retainer 164, ball 174 and ball seats 172 are also displaced therewith relative to valve housing 66. Lug member 182, however, remains axially stationary with respect to valve housing 66. Lug member 182 is axially retained between axially extending generally tubular ported member 184 and operator housing 68. The relative axially displacement between ball 174 and lug members 182 when inner mandrel assembly 76 is axially displaced causes ball 174 to rotate about its axis.

An axially extending and generally tubular outer sleeve 186 radially inwardly retains lug member 182 and links 166. Outer sleeve 186 is axially retained between ported member 184 and operator housing 68. Outer sleeve 186 maintains lugs 180 in cooperative engagement with openings 178 and maintains links 166 in cooperative engagement with ball retainers 90, 164.

With valve 50 in its open configuration as shown in FIGS. 3A–3E, outer inflation flow passage 188 formed therein is in a vented configuration. Conversely, when valve 50 is in its closed configuration as shown in FIGS. 2A–2E, inflation flow passage 188 is in a bypass configuration, permitting fluid pressure in a portion of flow passage 52 above ball 174 to be transmitted through inflation flow passage 188 to other tools located below tool 34 in drill string 30 such as seal assemblies 32.

Lower sleeve 86 permits fluid communication radially therethrough between flow passage 52 and inflation flow passage 188. Note that such fluid communication also permits fluid pressure in flow passage 52 to be applied to lower piston 104.

An axially extending generally tubular shuttle 196 is threadably attached to lower ball retainer 164 and is axially slidingly disposed within connector housing 70 and lower connector housing 71. A circumferential seal 198 externally carried on shuttle 196 sealingly engages axially extending bore 200 internally formed on connector housing 70. A series of three axially spaced apart circumferential seals 202, 204 and 206 are carried internally on lower connector housing 71 and sealingly engaged shuttle 196.

Figure 3E:
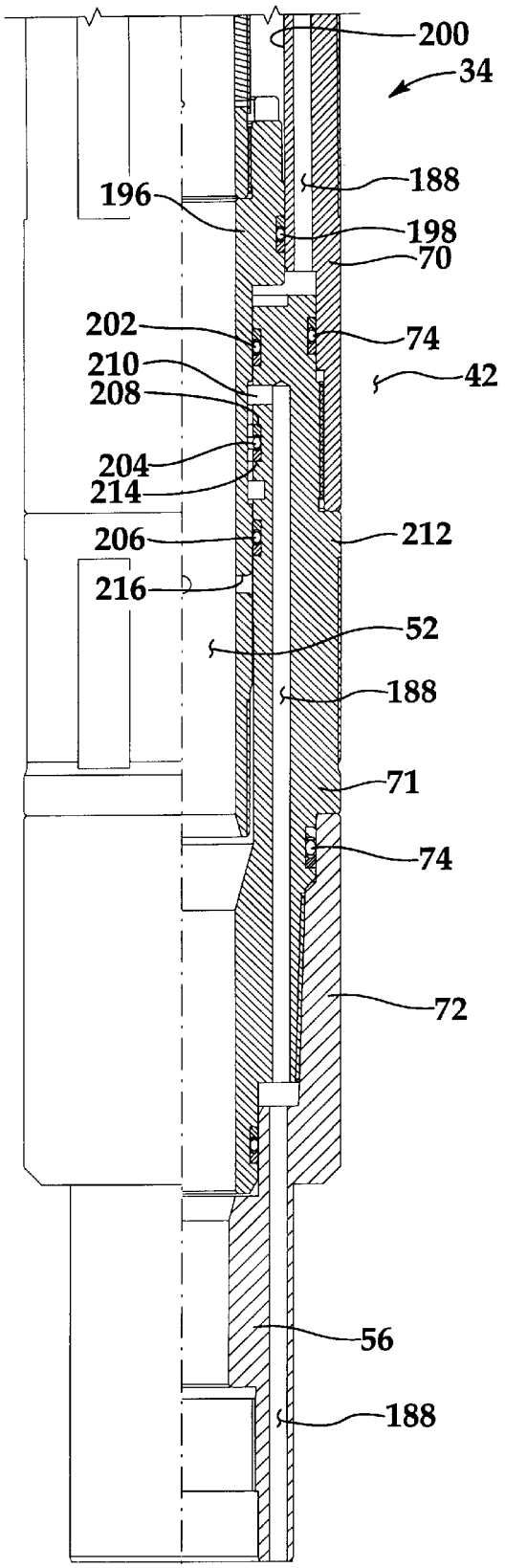

With valve 50 in its open configuration as shown in FIGS. 3A–3E, seals 202 and 206 sealingly engage shuttle 196 as shown in FIG. 3E. Seal 204 does not sealingly engage shuttle 196 due to a milled slot 208 externally formed on shuttle 196 being disposed radially opposite seal 204. The lack of sealing engagement between seal 204 and shuttle 196 permits fluid communication between annulus 42 and inflation flow passage 188 via openings 210 and 212 formed in lower connector housing 71. Opening 210 provides fluid communication from inflation flow passage 188 to annular area 214 radially between milled slot 208 and lower connector housing 71, and opening 212 provides fluid communication from annular area 214 to annulus 42. However, sealing engagement between seal 202 and shuttle 196 prevents fluid communication between inflation flow passage 188 of operator housing 68 and annular area 214.

The venting of inflation flow passage 188 to annulus 42, as shown in FIG. 3E, insures that when valve 50 is opened, high pressure fluid from inflation flow passage 188 will not travel through lower adapter 72 into other tools such as seal assemblies 32, causing inflation thereof. When it is desired to inflate seal assemblies 32, valve 50 may be closed as shown in FIGS. 2A–2E such that inflation flow passage 188 in lower adapter 72 is placed in fluid communication with inflation flow passage 188 in operator housing 68.

Figure 2E:
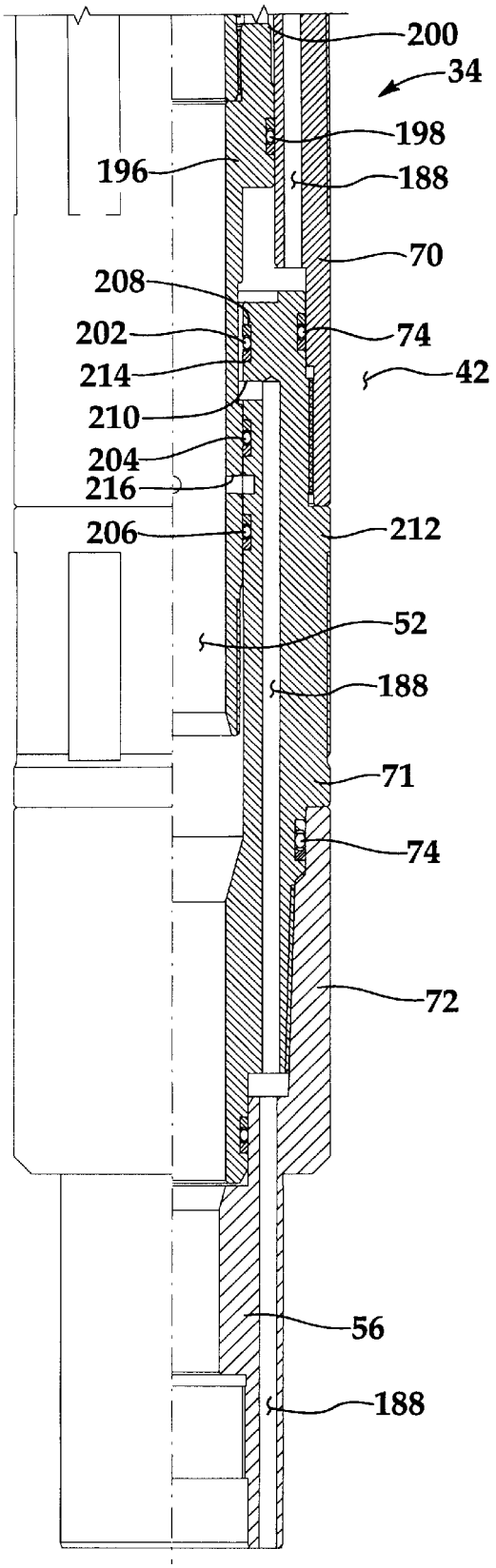

When valve 50 is closed, inner mandrel assembly 76 is displaced axially upward relative to operator housing 68. Since lower ball retainer 164 is axially secured to shuttle 196, shuttle 196 will also be displaced axially upward when inner mandrel assembly 76 is displaced axially upward as seen in FIG. 2E. When shuttle 196 is axially upwardly displaced, seals 204 and 206 sealably engage shuttle 196, but seal 202 does not. This is due to the fact that annular area 214 is now disposed radially opposite seal 202. In this configuration, fluid communication is permitted between inflation flow passage 188 in operating housing 68 and inflation flow passage 188 in lower adapter 72. The portion of flow passage 52 below ball 174 is vented to annulus 42 via a radially extending opening 216 formed through shuttle 196.

Representatively illustrated in FIGS. 4A–4F and FIGS. 5A–5F is one embodiment of early evaluation formation testing tool 1034 of the present invention. Tool 1034 as it is represented in FIGS. 5A–5F is configured in the position which it would normally be running into wellbore 40 such that fluids may flow axially through open valve 1050 (see FIG. 5E). Early evaluation testing tool 1034 as represented in FIG. 4A–4F is configured such that valve 1050 is in the closed position (see FIG. 4E), thereby preventing circulation of fluids through main axially flow passage 1052 which extends from upper internal threaded end 1054 to lower external threaded end 1056 of tool 1034. During a drilling operation, fluid, such as drilling mud, is circulated through drill string 30 to ports formed through drill bit 36 and up wellbore 40. It is understood that tool 1034 may be interconnected with such drill string 30 at its upper end 1054 and lower end 1056 without impeding such circulating flow of fluids therethrough during drilling operations.

Tool 1034 in its open configuration as shown in FIGS. 5A–5F, may have fluid circulated downward through drill string 30, through flow passage 1052 and through the ports in drill bit 36. From drill bit 36, such fluids are typically flowed back to the surface through annulus 42 formed radially between drill string 30 and wellbore 40.

Tool 1034 is uniquely capable of performing a variety of functions in response to various differences in fluid pressure between flow passageway 1052 and annulus 42. The absolute fluid pressure at any point in wellbore 40 is not determinative of the configuration of tool 1034. It is the differential fluid pressure from the flow passage 1052 to the annulus 42 that determines, among other things, whether valve 1050 is open or closed. The differential pressure between flow passage 1052 and annulus 42 is controllable by the operator and is generally proportional to the circulation rate of drilling mud.

Tool 1034 includes an axially extending and generally tubular upper connector 1058 which has upper end 1054 formed thereon. Upper connector 1058 may be threadably and sealably connected to a portion of drill string 30 for conveyance into wellbore 40. When so connected, flow passageway 1052 is in fluid communication with the interior of drill string 30.

An axially extending generally tubular upper housing 1060 is threadably and sealably connected to upper connector 1058. Upper housing 1060 is threadably connected to axially extending generally tubular upper intermediate housing 1061, which is threadably and sealably connected to axially extending generally tubular intermediate housing 1062, which is threadably and sealably connected to an axially extending generally tubular lower housing 1064. Lower housing 1064 is threadably and sealably connected to axially extending generally tubular valve housing 1066 which is threadably and sealably connected to axially extending generally tubular operator housing 1068 which is, in turn, threadably and sealably connected to axially extending generally tubular connector housing 1070. Connector housing 1070 is threadably and sealably connected to axially extending generally tubular lower connector housing 1071 which is threadably and sealably connected to axially extending generally tubular lower adapter 1072. Each of the above-described sealing connections are sealed by resilient o-ring seals 1074.

Disposed within upper connector 1058 is axially extending generally tubular inner mandrel assembly 1076 which is slidably received within internal bore 1078. Inner mandrel assembly 1076 includes upper end portion 1080, upper sleeve 1082, intermediate sleeve 1084, lower sleeve 1086 and upper ball retainer 1090. Upper end portion 1080, upper sleeve 1082, intermediate sleeve 1084, lower sleeve 1086 and upper ball retainer 1090 are threadably interconnected. A generally tubular screen 1092 for filtering debris from fluid passing therethrough is retained between internal shoulders formed on upper end portion 1080 and upper sleeve 1082 as well as lower sleeve 1086 and upper ball retainer 1090. Upper sleeve 1082 and lower sleeve 1086 include ports 1094 formed therethrough radially opposite screens 1092. Thus, fluid in flow passage 1052 may flow radially through inner mandrel assembly 1076 via ports 1094.

Upper housing 1060 and intermediate housing 1062 include ports 1096 formed radially therethrough. Ports 1096 permit fluid in annulus 42 to enter tool 1034. Together, ports 1094 and 1096 permit differential pressure between the fluid in flow passage 1052 and the fluid in annulus 1042 to act upon tool 1034 in a manner which causes valve 1050 to open or close as desired, among other operations.

Generally tubular upper piston 1098 is slidably and sealably received radially between intermediate housing 1061 and intermediate sleeve 1084. Upper piston 1098 includes an upper portion 1099 that is displaced axially with upper piston 1098. Internal circumferential seal 1100 carried on upper intermediate housing 1061 externally engages upper piston 1098. Generally tubular lower piston 1104 is slidably and sealably received radially between intermediate housing 1062 and intermediate sleeve 1084. Internal seals 1108 and 1109 carried on intermediate housing 1062 engages lower piston 1104.

It should be readily appreciated that when fluid pressure in flow passageway 1052 acting on the differential pressure areas of upper piston 1098 and lower piston 1104 via ports 1094, exceeds fluid pressure in annulus 1042, acting on the differential pressure areas of upper piston 1098 and lower piston 1104 via ports 1096, upper piston 1068 will be biased in an axially downward direction and lower piston 1104 will be biased in an axially upward direction. When fluid pressure in flow passageway 1052 exceeds that of annulus 1042, upper piston 1096 and lower piston 1104 are axially biased toward one another and, conversely, when fluid pressure in annulus 1042 exceeds that in flow passage 1052, upper piston 1098 and lower piston 1104 are axially biased away from one another. Internal shoulders 1112 formed on upper housing 1030 and lower housing 1034 limit the extent to which pistons 1098, 1104 may travel axially away from one another.

Spirally wound compression spring 1114 is installed axially between external shoulder 1116 formed on upper piston 1098 and intermediate housing 1062. Spirally wound compression spring 1118 is installed axially between external shoulder 1120 formed on lower piston sleeve 1121 and intermediate housing 1062. Springs 1114, 1118 are utilized to bias upper piston 1098 and lower piston 1104 axially away from one another. Thus, with no difference in fluid pressure between flow passage 1052 and annulus 42, springs 1114, 1118 will act to maintain upper piston 1098 and lower piston 1104 in their greatest axially spaced apart configuration.

A generally tubular upper pin retainer 1122 is threadably secured to upper end 1124 of upper piston sleeve 1125. A generally tubular lower pin retainer 1126 is threadably secured to lower end 1128 of lower piston sleeve 1121. A series of five radially inwardly extending and circumferentially spaced apart pins 1130 are installed through upper pin retainer 1122, such that each of the pins 1130 engage one of five corresponding J-slots or ratchet paths 1132 externally formed on a generally tubular axially extending upper ratchet 1134. A series of four radially inwardly extending and circumferentially spaced apart pins 1136 are installed through lower pin retainer 1126 such that each of the pins 1136 engage one of four corresponding J-slots or ratchet paths 1138 externally on a generally tubular axially extending lower ratchet 1140.

Upper ratchet 1134 and lower ratchet 1140 are externally rotatably disposed on intermediate sleeve 1084. Upper ratchet 1134 and lower ratchet 1140 are axially secured on intermediate sleeve 1084 between external shoulders 1142 formed on intermediate sleeve 1084 and upper sleeve 1082 and lower sleeve 1086, respectively. Thus, when upper piston 1098 and lower piston 1104 are axially displaced relative to intermediate sleeve 1084, the engagement of pins 1130, 1136 in the corresponding ratchet paths 1132, 1138, in some instances, cause ratchets 1134, 1140 to rotate about intermediate sleeve 1084.

It should be noted by one skilled in the art that the number of pins 1130, 1136 and corresponding ratchet paths 1132, 138 within ratchets 1134, 1140 may vary. The specific operation of pins 1130, 1136 in the corresponding ratchet paths 1132, 1138 as well as the rotation of ratchets 1134, 1140 about intermediate sleeve 1084 will be specifically discussed with reference to FIGS. 6 and 7 below.

In operation, as the differential pressure between flow passage 1052 and annulus 42 is increased by increasing the rate of circulation of fluids therethrough, upper piston 1098 is biased axially downward. Preferably, spring 1114 has a preload force caused by compressing spring 1114 when it is installed within tool 1034. Thus, a minimum differential fluid pressure is required to begin axially displacing upper piston 1098 downward. Preferably, the minimum differential fluid pressure is approximately 120 psi.

When the minimum differential fluid pressure is exceeded, upper piston 1098 will be displaced axially downward relative to upper housing 1060 and intermediate sleeve 1084. Internal pressure from axial flow passage 1052 enters tool 1034 through ports 1094 and travels to, among other places, seals 1101 and 1103. Seal 1101 is internally received in staging piston 1105 which is slidably and sealably disposed between upper housing 1060 and upper piston 1098. Seal 1103 is internally received within staging piston 1105 to provide a sealing engagement between staging piston 1105 and upper piston 1098. Fluid pressure from annulus 42 is received within tool 1034 through ports 1096 and travels between seals 1100, 1101 and 1103 to upwardly bias staging piston 1105. When the differential fluid pressure exceeds the minimum level, staging piston 1105 is displaced axially downward until it contacts shoulder 1107. In response to additional differential pressure, preferably approximately 500 psi, piston 1098 is displaced axially downward relative to upper housing 60 until pin retainer 1122 contacts shoulder 1109 placing piston 1098 in a first position.

A subsequent reduction in differential fluid pressure causes upper piston 1098 to axially displace upward relative to upper housing 1060 until radially protruding section 1111 of upper piston 1098 contacts shoulder 1113 of staging piston 1105. This configuration is the second position of piston 1098.

A further decrease in the differential fluid pressure results in a further upward axial displacement of piston 1098 and staging piston 1105 placing piston 1098 in its resting position. Alternatively, when the differential pressure is increased while piston 1098 is in its second position, piston 1098 will axially displace downwardly relative to upper housing 60 placing piston 1098 in a third position. A subsequent decrease in the differential pressure, allows piston 1098 to engage inner mandrel assembly 1076 when piston 1098 is in a fourth position. A further decrease in the differential fluid pressure allows piston 1098 to axially displace upward relative to upper housing 1060 thereby axially displacing inner mandrel assembly 1076 upward relative to upper housing 1060, operating valve 1050 from its open position to its closed position.

From this configuration, an increase in the differential fluid pressure axially displaces lower piston 1104 upward relative to lower housing 1064 placing lower piston 1104 in a first position. A subsequent decrease in the differential fluid pressure allows lower piston 1104 to displace axially downward relative to lower housing 1064 such that lower piston 1104 engages inner mandrel assembly 1076 placing lower piston 1104 in a second position. A further decrease in the differential fluid pressure allows lower piston 1104 to displace axially downward relative to lower housing 1064 thereby displacing inner mandrel assembly 1076 downward relative to lower housing 1064 and operating valve 1050 from the closed position to the open position.

Thus, it should be clear that upper piston 1098 is able to axially reciprocate within upper housing 1060 during normal drilling operations where the differential fluid pressure is typically increased to approximately 500–1,000 psi and then decreased to approximately 0 psi when drill pipe is added to drill string 30.

Figure 4A:
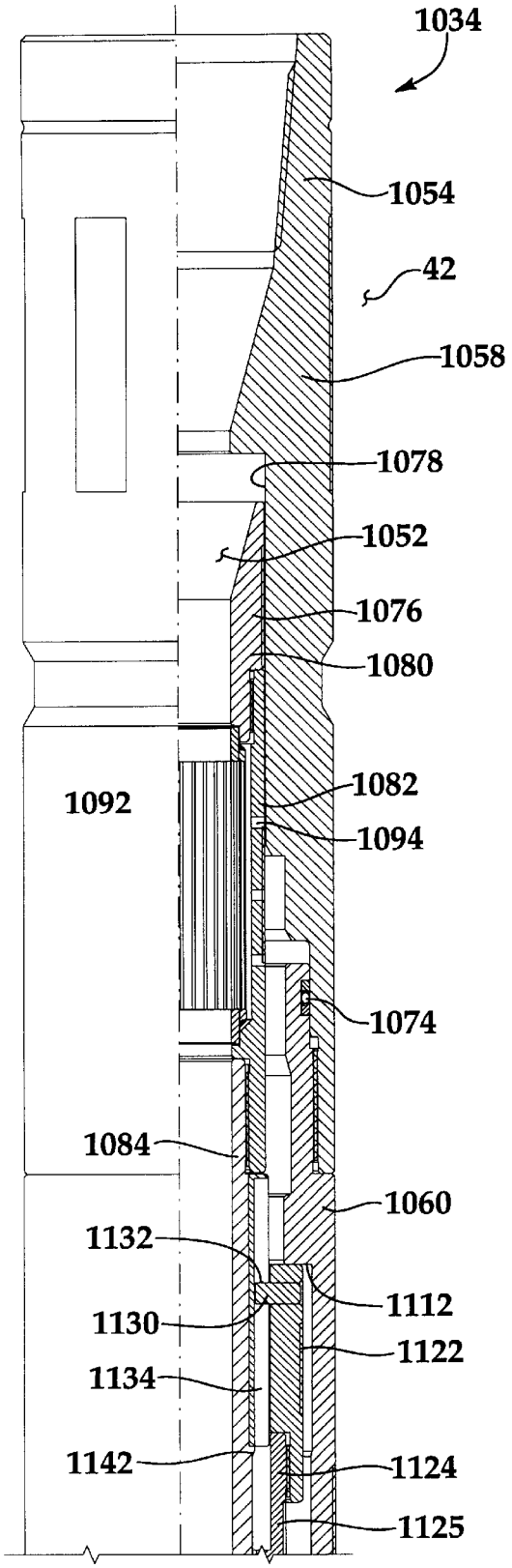
FIGS. 4A–4F are half sectional views partically cut away of successive axial portions of an early evaluation formation testing apparatus of the present invention in a closed position.
Figure 5A:
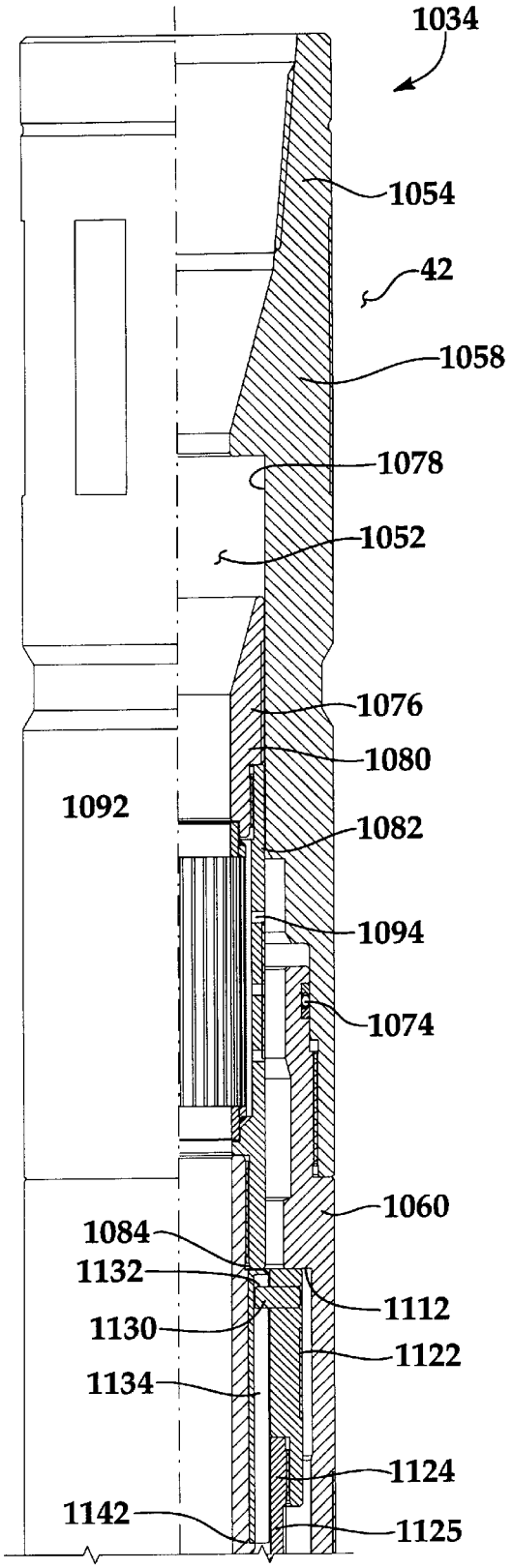
FIGS. 5A–5F are half sectional views partially cut away of successive axial portions of an early evaluation formation testing apparatus of the present invention in an open position.
Figure 4B:
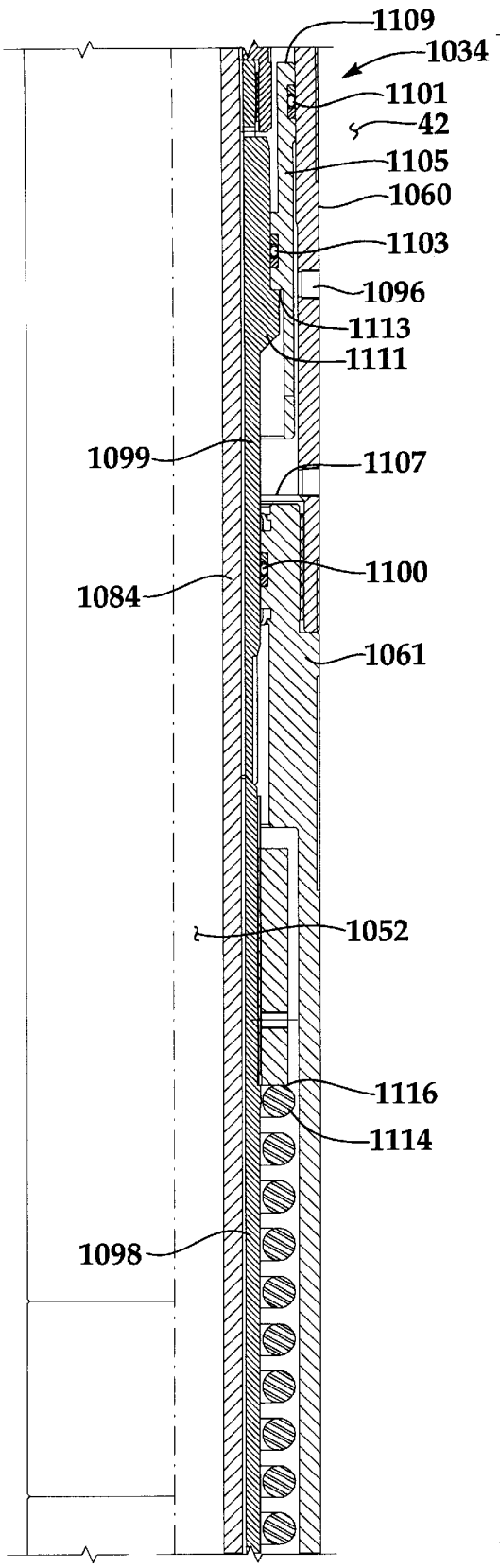
Figure 5B:
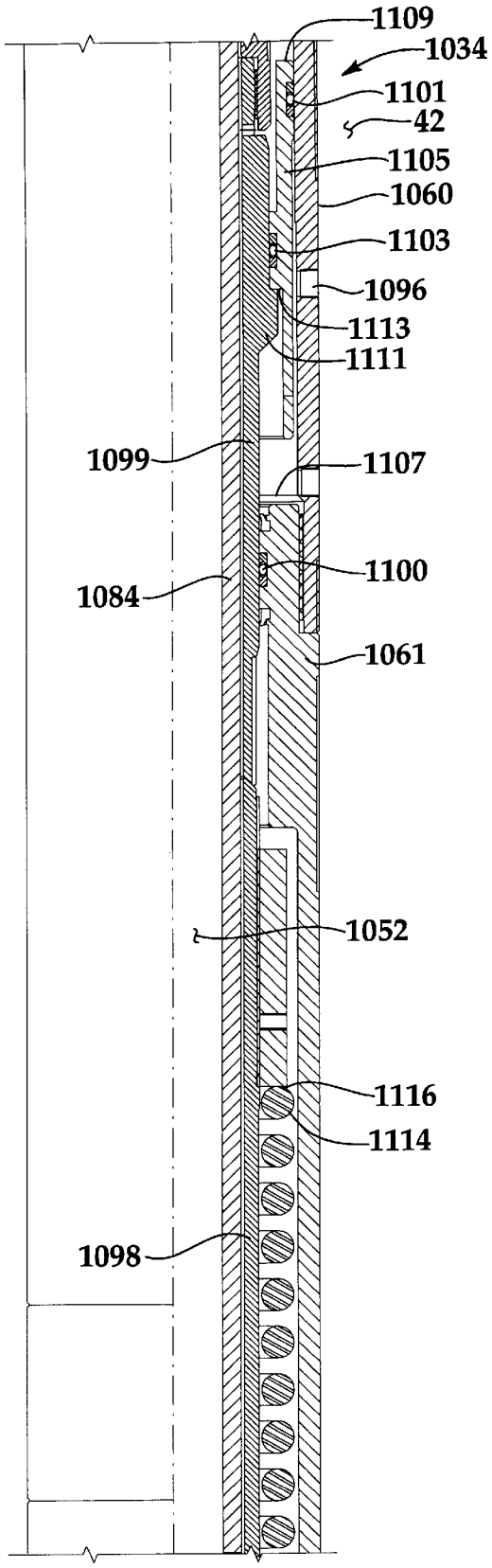
Figure 4C:
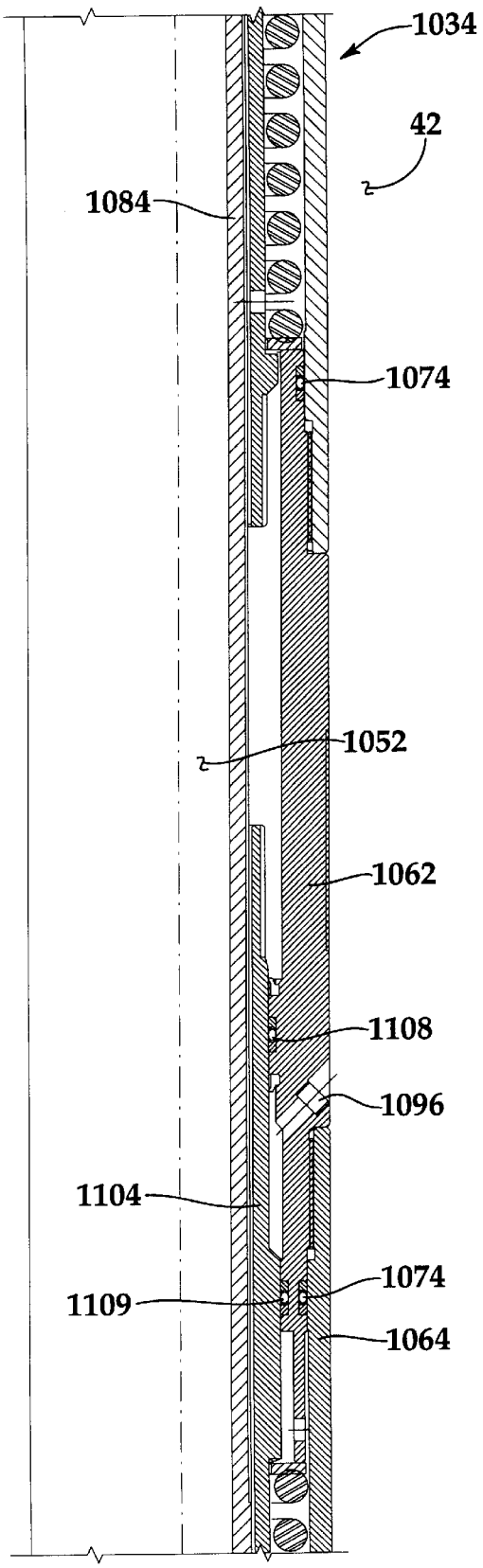
Figure 5C:
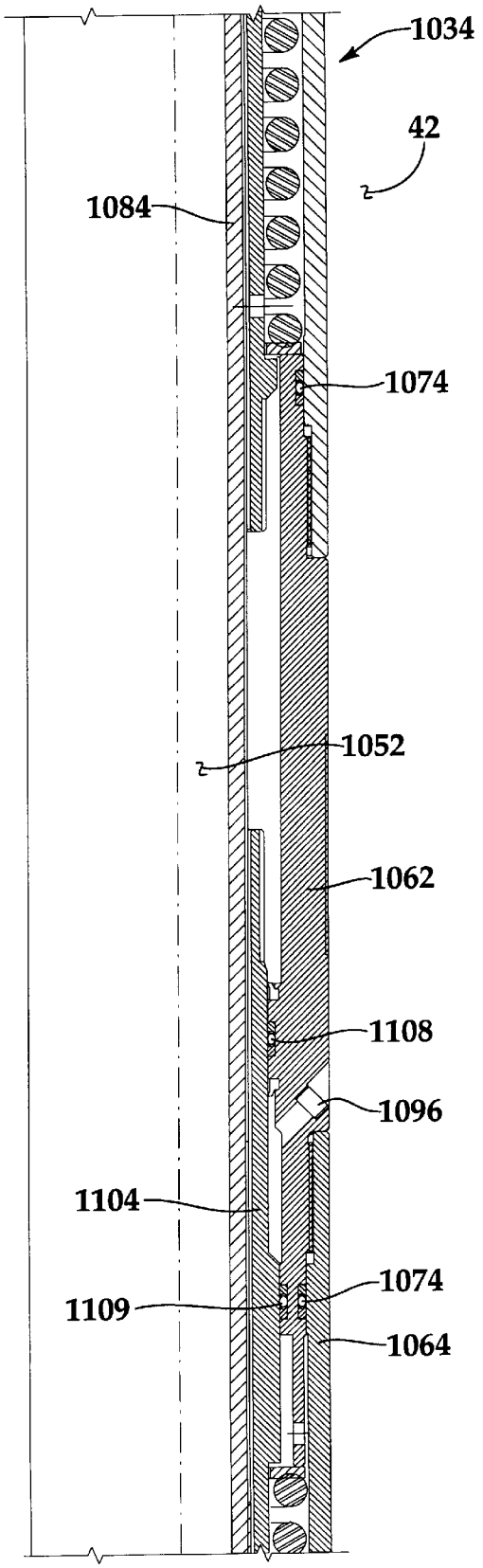
Figure 4D:
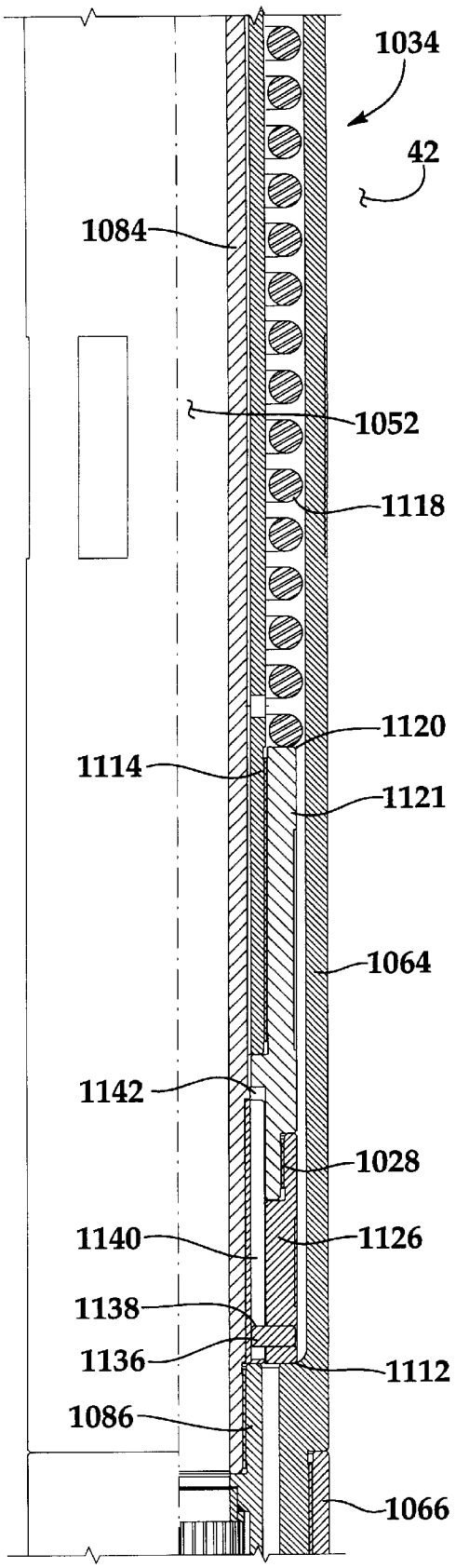
Figure 5D:
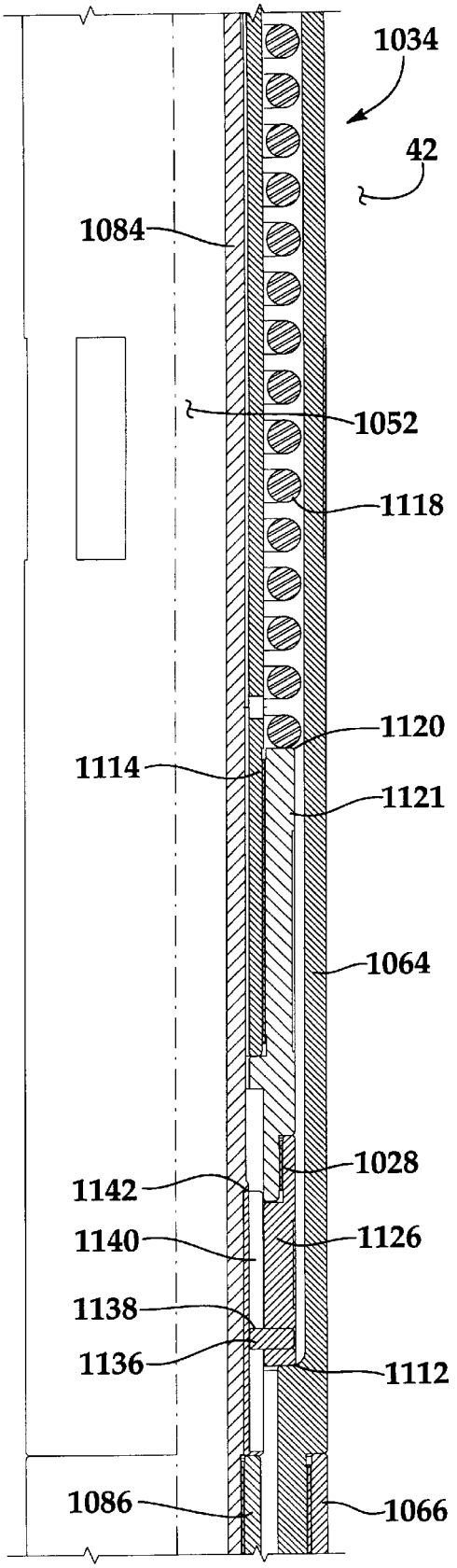
Figure 4E:
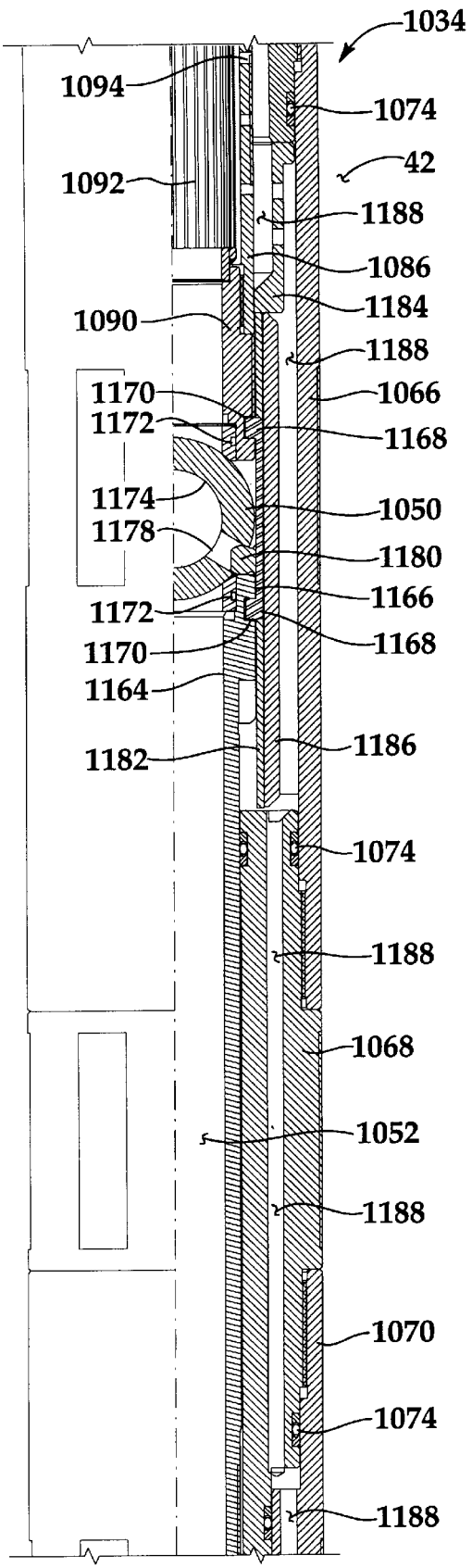
Figure 5E:
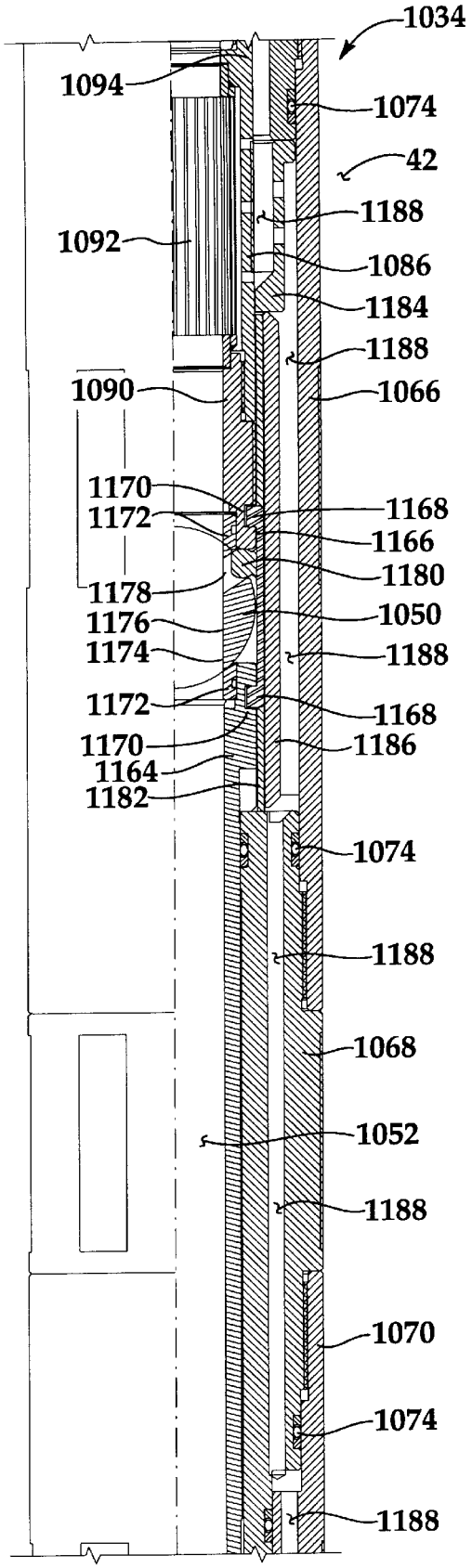

Referring specifically to FIGS. 4E and 5E, upper ball retainer 1090 is axially secured to axially extending generally tubular lower ball retainer 1164 by means of a circumferentially spaced apart series of generally C-shaped links 1166. Radially inwardly projecting end portions 1168 formed on each of the links 1166 are received in complimentary shaped grooves 1170 formed on each of the upper and lower ball retainers 1090, 1164. A ball seat 1172 of conventional design axially slidingly and sealingly received in each of the upper and lower ball retainers 1090, 1164. Ball seats 1172 also sealingly engage ball 1174, which has an opening 1176 formed axially therethrough. With valve 1050 in its open configuration, the flow passage 1052 extends axially through opening 1176.

Two eccentrically extending openings 1178 are formed through ball 1174. Openings 1178 are utilized to rotate ball 1174 about an axis perpendicular to opening 1176, in order to isolate opening 1176 from flow passage 1052 and thereby, close valve 1050. As seen in FIG. 4E, ball 1174 is rotated about is axis such that opening 1176 is in fluid isolation from flow passage 1052 by sealing engagement of ball seats 1172 with ball 1174.

A lug 1180 is received in each of the openings 1178. Each of the lugs 1180 projects inwardly from an axially extending lug member 1182. Links 1166 and lug members 1182 are disposed circumferentially about ball 1174 and ball retainers 1090, 1164. Due to the eccentric placement of openings 1178, lug members 1182 displace somewhat circumferentially when ball 1174 is rotated, lugs 1180 being retained in openings 1178 as ball 1174 rotates.

When internal mandrel assembly 1076 is displaced axially upward as will be more fully described in conjunction with FIGS. 6 and 7, upper ball retainer 1090, links 1166, lower ball retainer 1164, ball 1174 and ball seats 1172 are also displaced therewith relative to valve housing 1066. Lug member 1182, however, remains axially stationary with respect to valve housing 1066. Lug member 1182 is axially retained between axially extending generally tubular ported member 1184 and operator housing 1068. The relative axially displacement between ball 1174 and lug members 1182 when inner mandrel assembly 1076 is axially displaced causes ball 1174 to rotate about its axis.

An axially extending and generally tubular outer sleeve 1186 radially inwardly retains lug member 1182 and links 1166. Outer sleeve 1186 is axially retained between ported member 1184 and operator housing 1068. Outer sleeve 1186 maintains lugs 1180 in cooperative engagement with openings 1178 and maintains links 1166 in cooperative engagement with ball retainers 1090, 1164.

With valve 1050 in its open configuration as shown in FIGS. 5A–5F, outer inflation flow passage 1188 formed therein is in a vented configuration. Conversely, when valve 1050 is in its closed configuration as shown in FIGS. 4A–4F, inflation flow passage 1188 is in a bypass configuration, permitting fluid pressure in a portion of flow passage 1052 above ball 1174 to be transmitted through inflation flow passage 1188 to other tools located below tool 1034 in drill string 30 such as seal assemblies 32.

Lower sleeve 1086 permits fluid communication radially therethrough between flow passage 1052 and inflation flow passage 1188. Note that such fluid communication also permits fluid pressure in flow passage 1052 to be applied to lower piston 1104.

An axially extending generally tubular shuttle 1196 is threadably attached to lower ball retainer 1164 and is axially slidingly disposed within connector housing 1070 and lower connector housing 1071. A circumferential seal 1198 externally carried on shuttle 1196 sealingly engages axially extending bore 1200 internally formed on connector housing 1070. A series of three axially spaced apart circumferential seals 1202, 1204 and 1206 are carried internally on lower connector housing 1071 and sealingly engaged shuttle 1196.

Figure 5F:
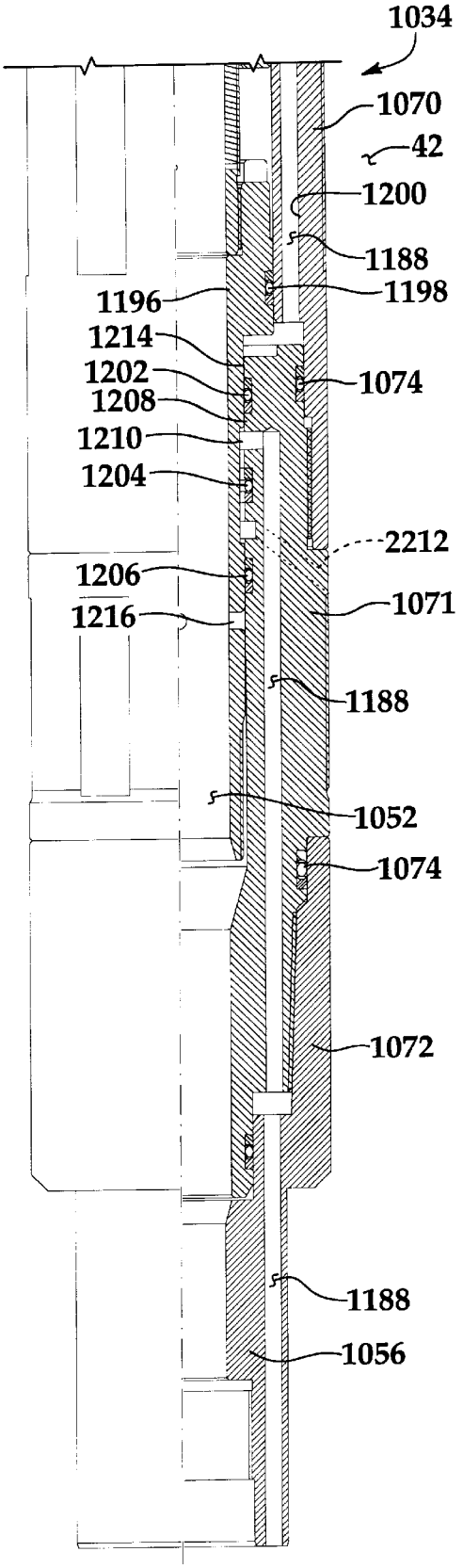

With valve 1050 in its open configuration as shown in FIGS. 5A–5F, seals 1202 and 1206 sealingly engage shuttle 1196 as shown in FIG. 5F. Seal 1204 does not sealingly engage shuttle 1196 due to a milled slot 1208 externally formed on shuttle 1196 being disposed radially opposite seal 1204. The lack of sealing engagement between seal 1204 and shuttle 1196 permits fluid communication between annulus 42 and inflation flow passage 1188 via openings 1210 and 1212 formed in lower connector housing 1071. Opening 1210 provides fluid communication from inflation flow passage 1188 to annular area 1214 radially between milled slot 1208 and lower connector housing 1071, and opening 1212 provides fluid communication from annular area 1214 to annulus 42. However, sealing engagement between seal 1202 and shuttle 1196 prevents fluid communication between inflation flow passage 1188 of operator housing 1068 and annular area 1214.

The venting of inflation flow passage 1188 to annulus 42, as shown in FIG. 5F, insures that when valve 1050 is opened, high pressure fluid from inflation flow passage 1188 will not travel through lower adapter 1072 into other tools such as seal assemblies 32, causing inflation thereof. When it is desired to inflate seal assemblies 32, valve 1050 may be closed as shown in FIGS. 4A–4F such that inflation flow passage 1188 in lower adapter 1072 is placed in fluid communication with inflation flow passage 1188 in operator housing 1068.

Figure 4F:
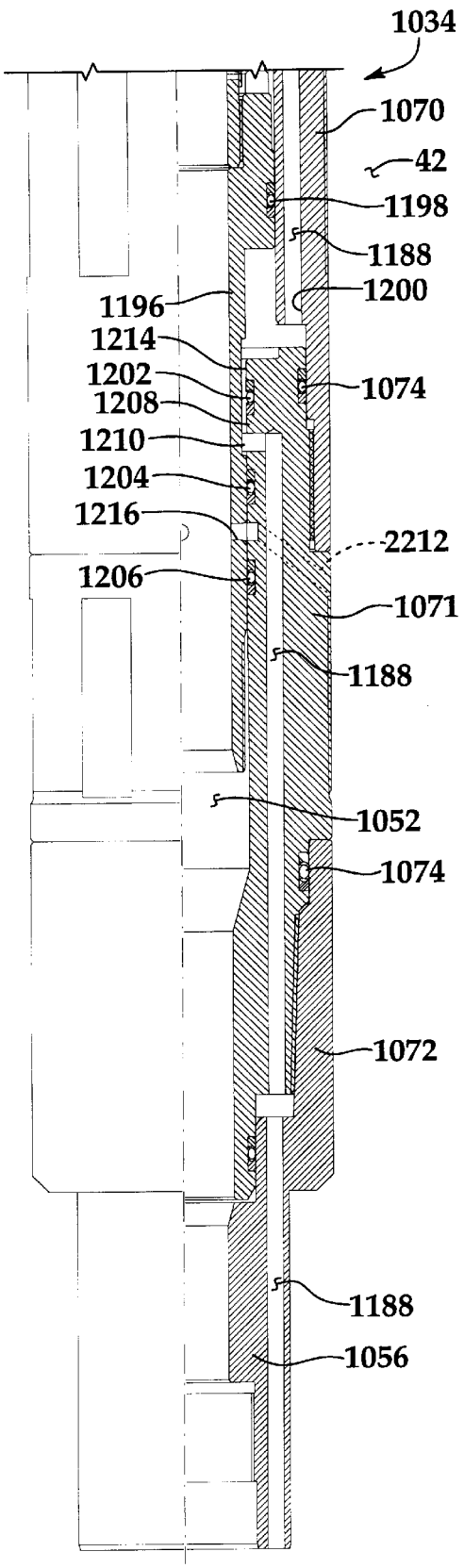

When valve 1050 is closed, inner mandrel assembly 1076 is displaced axially upward relative to operator housing 1068. Since lower ball retainer 1164 is axially secured to shuttle 1196, shuttle 1196 will also be displaced axially upward when inner mandrel assembly 1076 is displaced axially upward as seen in FIG. 4F. When shuttle 1196 is axially upwardly displaced, seals 1204 and 1206 sealably engage shuttle 1196, but seal 1202 does not. This is due to the fact that annular area 1214 is now disposed radially opposite seal 1202. In this configuration, fluid communication is permitted between inflation flow passage 1188 in operating housing 1068 and inflation flow passage 1188 in lower adapter 1072. The portion of flow passage 1052 below ball 1174 is vented to annulus 42 via a radially extending opening 1216 formed through shuttle 1196. Referring now to FIG. 6, a circumferential view of the upper ratchet 134 is depicted and rotated 90° for convenience of illustration, such that the upper direction is to the left of the figure. Upper ratchet 134 is pictured in an unrolled configuration from its normal generally cylindrical shape so that it may be viewed from a two-dimensional perspective. It should be understood that the operation of upper ratchet 134 depicted in FIGS. 2A and 3A is the same as the operation of upper ratchet 1034 as depicted in FIGS. 4A and 5A. For convenience, however, FIG. 6 will be described in terms of upper ratchet 134 and its interaction with other parts as described in FIGS. 2 and 3.

It should be understood by one skilled in the art that upper ratchet 134 need not have five ratchet paths 132 formed therein. Other quantities of ratchet paths, and otherwise configured ratchet paths, may be utilized without departing from the principles of the present invention.

Pins 130 are disposed in ratchet paths 132 in a plurality of positions. For convenience of illustration and clarity of description, displacement of only one of the pins 130 in the ratchet paths 132 will be described herein, it being understood that each of the pins 130 is likewise displaced in circumferentially spaced apart relationship to the described pin displacement.

As described above, pins 130 slide within ratchet paths 132 as upper piston 98 is displaced axially relative to upper housing 60. As the differential fluid pressure from flow passage 52 to annulus 42 is increased, upper piston 98, upper pin retainer 126, and pin 130 are biased axially downward by the differential fluid pressure as described herein above. Preferably, spring 114 has a preload force, due to the spring being compressed when it is installed within tool 34. Thus, a minimum differential pressure is required to begin axial displacement of upper piston 98. Preferably, the minimum differential fluid pressure is approximately 120 psi.

When the minimum differential pressure is exceeded, upper piston 98, upper pin retainer 122, and pin 130 will be displaced axially downward relative to ratchet 134. For convenience of description, hereinafter displacement of pin 130 relative to ratchet 134 will be described, it being understood that upper piston 98 and upper pin retainer 126 are displaced along with pin 130, and that they are displaced relative to upper housing 60.

Preferably, when the differential fluid pressure has reached approximately 160 psi, pin 130 will be displaced from its resting position 300 to a first position 302 which corresponds to the first position of piston 98. As pin 130 moves from position 300 to position 302, ratchet 134 has been circumferentially displaced relative to pin 130 and intermediate sleeve 84. If additional differential fluid pressure is applied, pin 130 will continue to displace axially downward relative to ratchet 134 along ratchet path 132 to position 304.

Alternatively, if the differential pressure within tool 34 is reduced, pin 130 will travel axially upward from position 302 or position 304 to position 306 which corresponds to the second position of upper piston 98. From position 306, if the differential fluid pressure is reduced, pin 130 will travel to position 300, thereby allowing for the reciprocation of pin 130 through ratchet path 132 as the differential pressure within tool 34 is cycled, for example, during a drilling operation.

Alternatively, if the differential pressure within tool 34 is increased when pin 130 is in position 306, pin 130 will axially downwardly slide relative to ratchet 134 to position 308 which corresponds with the third position of piston 98 relative to upper housing 60. From position 308, if the differential pressure within tool 34 is reduced, pin 130 will engage ratchet path 132 at surface 310 placing pin 130 in position 312 corresponding with the fourth position of piston 98. When the differential pressure is further reduced, pin 130 applies an upward bias force against surface 310 of ratchet path 132 thereby upwardly displacing ratchet 134 and inner mandrel assembly 76 thereby operating valve 50 to a closed position. When the differential pressure is, again, increased within tool 34, pin 130 travels from position 312 to position 314 thereby allowing pin 130 to again reciprocate within ratchet path 132.

Now referring to FIG. 7, a circumferential view of lower ratchet 140 is depicted and rotated 900 for convenience of illustration, such that the upward direction is to the left of the figure. Lower ratchet 140 is shown in an unrolled position from its normal generally cylindrical shape so that it is viewed from a two-dimensional perspective.

It should be understood that the operation of lower ratchet 140 depicted in FIGS. 2C and 3C is the same as the operation of lower ratchet 1040 as depicted in FIGS. 4D and 5D. For convenience, however, FIG. 7 will be described in terms of lower ratchet 140 and its interaction with other parts as described in FIGS. 2 and 3.

Even though lower ratchet 140 is depicted as having four ratchet paths 138 in FIG. 7, it should be understood by one skilled in the art that the quantity of ratchet paths as well as the configuration of the ratchet paths may be changed without departing from the principles of the present invention.

Pins 136 are disposed in ratchet paths 138. For convenience of illustration and clarity of description, displacement of only one of the pins 136 in ratchet paths 138 will be described herein, it being understood that each of the pins 136 is likewise displaced in a circumferentially spaced apart relationship to the described pin 136.

Prior to the operation of valve 50 from the open position to the closed position, pin 136 reciprocates between position 316 and position 318. Once valve 50 has been operated from the open position to the closed position in response to the axial displacement of inner mandrel assembly 76 in an upward direction, pin 136 is axially displaced downwards to position 320. When the differential pressure within tool 34 is increased, pin 136 will be displaced axially upward from position 320 to position 322 which corresponds with the first position of lower mandrel 104. When the differential pressure is decreased, pin 136 is axially displaced downwardly from position 322 to position 324 thereby engaging surface 326 of ratchet path 138. A subsequent reduction in the differential pressure will result in pin 136 downwardly biasing ratchet 140 thereby downwardly displacing inner mandrel assembly 76 axially relative to intermediate housing 62 and operating valve 50 from a closed position to an open position.

A subsequent increase in the differential pressure causes pin 136 to axially displace upward relative to ratchet 140 from position 324 to position 322 and further to position 318. It should be noted by one skilled in the art that pin 136 circumferentially steps through adjacent ratchet paths 138 upon each cycle of valve operation.

Therefore, the apparatus for early evaluation formation testing has inherent advantages over the prior art. As certain embodiments of the invention have been illustrated for the purposes of this disclosure, numerous changes in the arrangement and construction of the parts may be made by those skilled in the art, which changes are embodied within the scope and spirit of the present invention as defined by the appended claims.

What is claimed is:

1. A downhole tool comprising:

a housing;

a mandrel having a fluid passageway extending axially therethrough, said mandrel slidably disposed within said housing;

a valve disposed within said mandrel, said valve having first and second positions to selectively permit and prevent fluid flow through said fluid passageway of said mandrel;

first and second pistons slidably disposed between said housing and said mandrel, said first and second pistons slidably displaceable in opposite directions relative to said housing in response to a differential fluid pressure, said first and second pistons selectively engagable with said mandrel to respectively displace said mandrel in first and second directions, thereby operating said valve between said first and second positions; and a limiter slidably disposed between said mandrel and said housing, said limiter stalling the displacement of said first piston in said first direction when said differential fluid pressure is reduced from a first predetermined differential fluid pressure to a second predetermined differential fluid pressure.

2. The downhole tool as recited in claim 1 wherein said limiter further comprises a collet spring.

3. The downhole tool as recited in claim 1 wherein said limiter further comprises a staging piston.

4. The downhole tool as recited in claim 1 wherein said first predetermined differential fluid pressure is more than about 160 psi and wherein said second predetermined differential fluid pressure is about 120 psi.

5. The downhole tool as recited in claim 1 wherein said first piston engages said mandrel when said differential fluid pressure is increased from said second predetermined differential fluid pressure to a third predetermined differential fluid pressure and reduced from said third predetermined differential fluid pressure to a fourth predetermined differential fluid pressure.

6. The downhole tool as recited in claim 5 wherein said third predetermined differential fluid pressure is more than about 160 psi and wherein said fourth predetermined differential fluid pressure is about 120 psi.

7. The downhole tool as recited in claim 5 wherein said mandrel is displaced in said first direction when said differential fluid pressure is reduced below said fourth predetermined differential fluid pressure, thereby operating said valve from said first position to said second position.

8. The downhole tool as recited in claim 7 wherein said second piston engages said mandrel when said differential fluid pressure is increased to a fifth predetermined differential fluid pressure and reduced to a sixth predetermined differential fluid pressure.

9. The downhole tool as recited in claim 8 wherein said fifth predetermined differential fluid pressure is more than about 160 psi and wherein said sixth predetermined differential fluid pressure is about 120 psi.

10. The downhole tool as recited in claim 8 wherein said mandrel is displaced in said second direction when said differential fluid pressure is reduced below said sixth predetermined differential fluid pressure, thereby operating said valve from said second position to said first position.

11. The downhole tool as recited in claim 1 further comprising:

a ratchet mechanism rotatably disposed between said mandrel and said first piston; and a pin extending radially inwardly from said first piston and being selectively engagable with said ratchet mechanism such that said mandrel is selectively displaceable in said first direction when said piston is displaced in said first direction.

12. The downhole tool as recited in claim 1 further comprising:

a ratchet mechanism rotatably disposed between said mandrel and said second piston; and a pin extending radially inwardly from said second piston and selectively engagable with said ratchet mechanism such that said mandrel is selectively displaceable in said second direction when said piston is displaced in said second direction.

13. The downhole tool as recited in claim 1 further comprising:

a first ratchet mechanism rotatably disposed between said mandrel and said first piston;

a second ratchet mechanism rotatably disposed between said mandrel and said second piston; and first and second pins respectively extending radially inwardly from said first and second pistons and selectively engagable with said first and second ratchet mechanisms such that said mandrel is selectively displaceable in said first direction when said first piston is displaced in said first direction and selectively displaceable in said second direction when said second piston is displaced in said second direction.

14. A downhole tool comprising:

a housing;

a mandrel having a fluid passageway extending axially therethrough, said mandrel slidably disposed within said housing;

a valve disposed within said mandrel, said valve having first and second positions to selectively permit and prevent fluid flow through said fluid passageway of said mandrel;

a piston slidably disposed between said housing and said mandrel, said piston slidably displaceable relative to said housing in response to a differential fluid pressure, said piston selectively engagable with said mandrel to displace said mandrel relative to said housing; and a limiter slidably disposed between said mandrel and said housing, said limiter stalling the displacement of said piston in a first direction when said differential fluid pressure is reduced from a first predetermined differential fluid pressure to a second predetermined differential fluid pressure.

15. The downhole tool as recited in claim 14 wherein said limiter further comprises a collet spring.

16. The downhole tool as recited in claim 14 wherein said limiter further comprises a staging piston.

17. The downhole tool as recited in claim 14 wherein said first predetermined differential fluid pressure is more than about 160 psi and wherein said second predetermined differential fluid pressure is about 120 psi.

18. The downhole tool as recited in claim 14 further comprising:

a ratchet mechanism rotatably disposed between said mandrel and said first piston; and a pin extending radially inwardly from said piston and being selectively engagable with said ratchet mechanism such that said mandrel is selectively displaceable in said first direction when said piston is displaced in said first direction.

19. The downhole tool as recited in claim 14 wherein said piston engages said mandrel when said differential fluid pressure is increased from said second predetermined differential fluid pressure to a third predetermined differential fluid pressure and reduced from said third predetermined differential fluid pressure to a fourth predetermined differential fluid pressure.

20. The downhole tool as recited in claim 19 wherein said third predetermined differential fluid pressure is more than about 160 psi and wherein said fourth predetermined differential fluid pressure is about 120 psi.

21. The downhole tool as recited in claim 19 wherein said mandrel is displaced in said first direction when said differential fluid pressure is reduced below said fourth predetermined differential fluid pressure, thereby operating said valve from said first position to said second positions.

22. A downhole tool operably positionable in wellbore comprising:

a housing;

a mandrel having a fluid passageway extending axially therethrough, said mandrel slidably disposed within said housing;

a valve disposed within said mandrel, said valve having first and second positions to selectively permit and prevent fluid flow through said fluid passageway of said mandrel;

a piston slidably disposed between said housing and said mandrel, said piston slidably displaceable relative to said housing in response to a differential fluid pressure;

a ratchet mechanism rotatably disposed between said mandrel and said piston;

a pin extending radially inwardly from said piston and selectively engagable with said ratchet mechanism such that said mandrel is selectively displaceable in a first direction when said piston is displaced in said first direction; and a limiter slidably disposed between said mandrel and said housing, said limiter stalling the displacement of said piston in said first direction when said differential fluid pressure is reduced from a first predetermined differential fluid pressure to a second predetermined differential fluid pressure.

23. The downhole tool as recited in claim 22 wherein said limiter further comprises a collet spring.

24. The downhole tool as recited in claim 22 wherein said limiter further comprises a staging piston.

25. The downhole tool as recited in claim 22 wherein said pin engages said ratchet mechanism when said differential fluid pressure is decreased from said first predetermined differential fluid pressure to a second predetermined differential fluid pressure, increased to a third predetermined differential fluid pressure and decreased to a fourth predetermined differential fluid pressure.

26. The downhole tool as recited in claim 25 wherein said first predetermined differential fluid pressure is more than about 160 psi, wherein said second predetermined differential fluid pressure is about 120 psi, wherein said third predetermined differential fluid pressure is more than about 160 psi and wherein said fourth predetermined differential fluid pressure is about 120 psi.

27. The downhole tool as recited in claim 25 wherein said mandrel is displaced in said first direction when said differential fluid pressure is reduced below said fourth predetermined differential fluid pressure, thereby operating said valve from said first position to said second position.

28. A method for operating a downhole tool having a housing, a mandrel slidably disposed within said housing, a valve disposed within said mandrel and a piston slidably disposed between said housing and said mandrel, the method comprising:

applying a differential fluid pressure to said piston;

displacing said piston relative to said housing;

selectively engaging said piston with said mandrel;

displacing said piston and said mandrel in a first direction;

stalling the displacement of said piston with a limiter; and operating said valve from a first position to a second position.

29. The method as recited in claim 28 wherein the step of selectively engaging said piston with said mandrel further comprises the steps of:

increasing said differential fluid pressure to a first predetermined differential fluid pressure;

decreasing said differential fluid pressure to a second predetermined differential fluid pressure;

increasing said differential fluid pressure to a third predetermined differential fluid pressure; and decreasing said differential fluid pressure to a fourth predetermined differential fluid pressure.

30. The method as recited in claim 29 wherein said first predetermined differential fluid pressure is more than about 160 psi, wherein said second predetermined differential fluid pressure is about 120 psi, wherein said third predetermined differential fluid pressure is more than about 160 psi and wherein said fourth predetermined differential fluid pressure is about 120 psi.

31. The method as recited in claim 30 wherein the step of displacing said piston and said mandrel in a first direction further comprises decreasing said differential fluid pressure below said fourth predetermined differential fluid pressure.

32. A method for operating a downhole tool having a housing, a mandrel slidably disposed within said housing, a valve disposed within said mandrel and first and second pistons slidably disposed between said housing and said mandrel, the method comprising:

applying a differential fluid pressure to said first and second pistons;

displacing said first and second pistons in opposite directions relative to said housing;

selectively engaging said first piston with said mandrel;

displacing said first piston and said mandrel in a first direction;

operating said valve from a first position to a second position;

selectively engaging said second piston with said mandrel;

displacing said second piston and said mandrel in a second direction; and operating said valve from said second position to said first position.

33. The method as recited in claim 22 wherein the step of selectively engaging said piston with said mandrel further comprises the step of stalling the displacement of said piston with a limiter.

34. The method as recited in claim 32 wherein the step of selectively engaging said first piston with said mandrel further comprises the steps of:

increasing said differential fluid pressure to a first predetermined differential fluid pressure;

decreasing said differential fluid pressure to a second predetermined differential fluid pressure;

increasing said differential fluid pressure to a third predetermined differential fluid pressure; and decreasing said differential fluid pressure to a fourth predetermined differential fluid pressure.

35. The method as recited in claim 34 wherein said first predetermined differential fluid pressure is more than about 160 psi, wherein said second predetermined differential fluid pressure is about 120 psi, wherein said third predetermined differential fluid pressure is more than about 160 psi and wherein said fourth predetermined differential fluid pressure is about 120 psi.

36. The method as recited in claim 34 wherein the step of displacing said first piston and said mandrel in said first direction further comprises decreasing said differential fluid pressure below said fourth predetermined differential fluid pressure.

37. The method as recited in claim 36 wherein the step of selectively engaging said second piston with said mandrel further comprises the steps of:

increasing said differential fluid pressure to a fifth predetermined differential fluid pressure; and decreasing said differential fluid pressure to a sixth predetermined differential fluid pressure.

38. The method as recited in claim 37 wherein said first predetermined differential fluid pressure is more than about 160 psi and wherein said second predetermined differential fluid pressure is about 120 psi.

39. The method as recited in claim 38 wherein the step of displacing said second piston and said mandrel in said second direction further comprises the step of decreasing said differential fluid pressure below said sixth predetermined differential fluid pressure.

* * * * *